US009022276B2

(12) United States Patent
Little

(10) Patent No.: US 9,022,276 B2
(45) Date of Patent: May 5, 2015

(54) DUAL-USE DISPLAY TRAY/CONTAINER

(71) Applicant: Troy Little, Thomasville, PA (US)

(72) Inventor: Troy Little, Thomasville, PA (US)

(73) Assignee: York Container Company, York, PA (US)

( * ) Notice: Subject to any disclaimer, the term of this patent is extended or adjusted under 35 U.S.C. 154(b) by 83 days.

(21) Appl. No.: 13/928,663

(22) Filed: Jun. 27, 2013

(65) Prior Publication Data

US 2014/0001249 A1 Jan. 2, 2014

Related U.S. Application Data

(60) Provisional application No. 61/666,192, filed on Jun. 29, 2012.

(51) Int. Cl.

| | |
|---|---|
| ***B65D 5/42*** | (2006.01) |
| ***B65D 5/16*** | (2006.01) |
| ***B65D 5/48*** | (2006.01) |
| ***B65D 5/496*** | (2006.01) |
| ***B65D 5/54*** | (2006.01) |

(52) U.S. Cl.

CPC .. *B65D 5/42* (2013.01); *B65D 5/16* (2013.01); *B65D 5/48014* (2013.01); *B65D 5/4804* (2013.01); *B65D 5/542* (2013.01)

(58) Field of Classification Search

USPC ..... 229/120.11, 120.25, 120.36, 120.38; 206/521.4, 736, 784; 493/121

See application file for complete search history.

(56) References Cited

U.S. PATENT DOCUMENTS

| | | | | |
|---|---|---|---|---|
| 2,983,421 | A | 5/1961 | Turpin | |
| 3,049,279 | A | 8/1962 | Mairs et al. | |
| 3,954,220 | A | 5/1976 | Foster | |
| 4,293,091 | A | 10/1981 | Gerard | |
| 4,487,358 | A | 12/1984 | Ambrose | |
| 4,651,918 | A | 3/1987 | Moore et al. | |
| 5,505,368 | A * | 4/1996 | Kanter et al. | 229/122.32 |
| 5,524,815 | A * | 6/1996 | Sheffer | 229/120.18 |
| 5,826,728 | A | 10/1998 | Sheffer | |
| 6,168,027 | B1 | 1/2001 | Esser | |
| 6,871,778 | B2 | 3/2005 | Petrelli et al. | |
| 7,861,916 | B2 | 1/2011 | Little | |
| 2007/0278282 | A1 * | 12/2007 | Jolley et al. | 229/125.19 |

* cited by examiner

*Primary Examiner* — Gary Elkins
*Assistant Examiner* — Christopher Demeree
(74) *Attorney, Agent, or Firm* — Barnes & Thornburg LLP

(57) ABSTRACT

Methods for manufacturing a dual use display tray/container pre-assembly and a dual use display tray/container having a plurality of auto-erectable cells. A method includes providing a primary blank having a plurality of panels and a supplementary blank having a plurality of panels. A method also includes providing only a single blank having a plurality of panels. A dual-use display tray/container includes a plurality of auto-erected cells. A dual use display tray/container also includes a plurality of removable panels and window access material to provide access to the plurality of auto-erected cells.

16 Claims, 25 Drawing Sheets

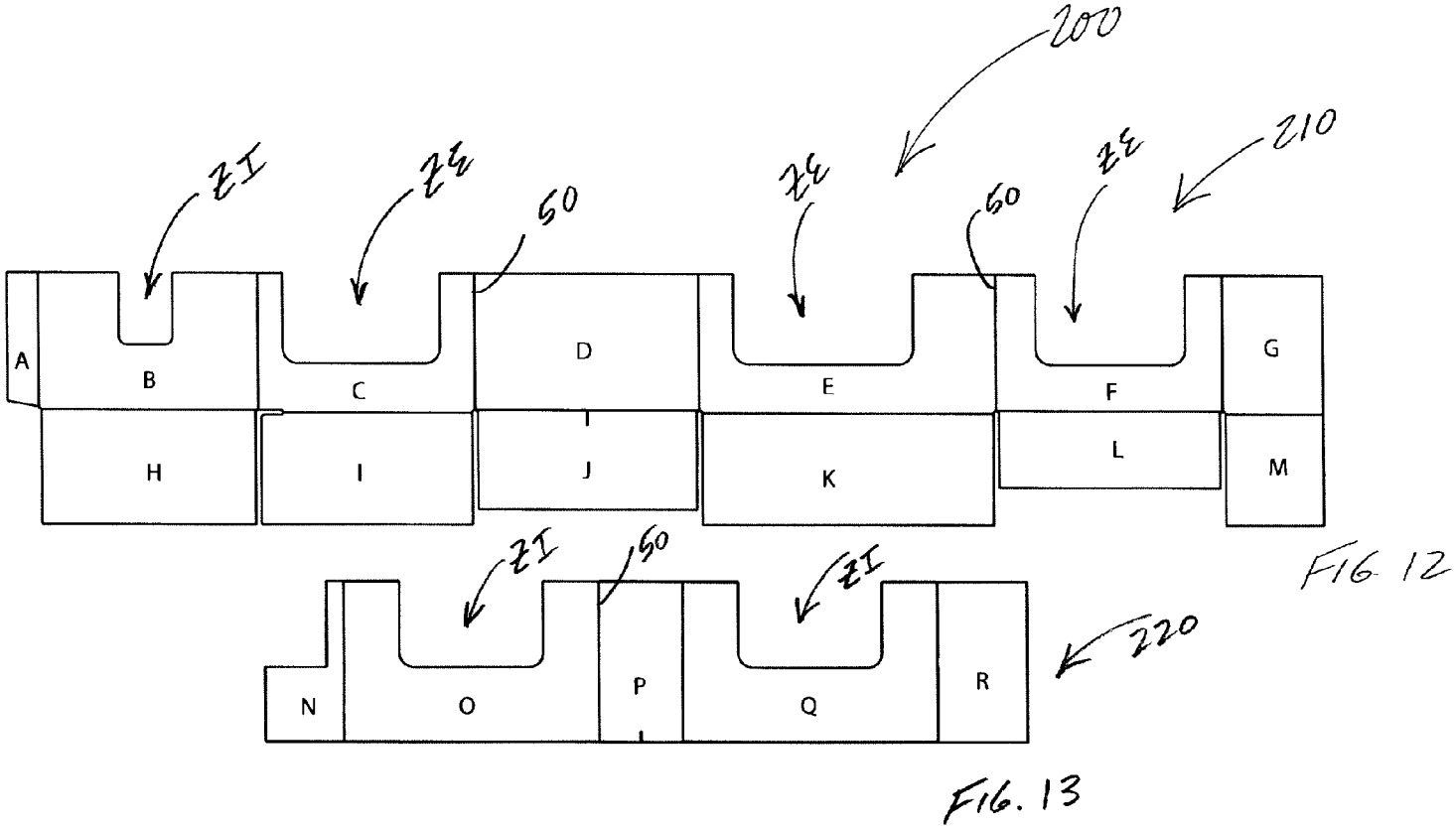
200
210
220
A
B
C
D
E
F
G
H
I
J
K
L
M
N
O
P
Q
R
60
60
60
60
34
34
34

1500
QE
PD
O
ND
ME
G
L
F
K
E
J
D
I
C
H
B
A
60
Y
500
510

DUAL-USE DISPLAY TRAY/CONTAINER

CROSS-REFERENCE TO RELATED APPLICATIONS

This application claims priority under 35 U.S.C. §119(e) to U.S. Provisional Application Ser. No. 61/666,192, filed Jun. 29, 2012.

BACKGROUND AND SUMMARY

The present disclosure relates, in general, to the manufacture of packaging, or containers, that may be readily used to transport product and/or display the product contents of the containers following delivery to a customer. Such packaging or containers may be considered to be dual use containers.

Suppliers of containers are being encouraged by retailers to supply more containers that are constructed to be dual purpose. Thus, such containers need to first be configured to be able to be shipped and carry product safely to a store, and second, need to arrive in a display-ready condition or configured to be easily converted, without any knives or tools, into a display-ready condition, such as a display tray, that can then be placed on a display stand, a rack, or a shelf. The challenge is using the minimum possible amount of materials and remaining cost effective, especially when the container supplier or manufacturer may be currently utilizing just a standard brown box shipping container.

As suggested above, various types of containers are conventionally provided for storing product in and transporting product to a retail environment for ultimate display to prospective customers, such as consumers. As is known in the packaging industry, such containers can be configured and transported to manufacturing and/or retail environments for display in a knock-down form, that is, in a flattened condition known as a pre-assembly. Panels of the flattened pre-assembly are glued, stapled or otherwise affixed or joined together such that the panels are substantially configured to be in a pre-assembled state. In such a pre-assembled or knock-down state, the personnel ultimately assembling or erecting the container have been known to need to manually open, or spread apart selected panels of the container pre-assembly and manually affix two or more of the panels together into an assembled condition of the container. Such final assembly of the container thus requires a good deal of manual labor and is performed prior to loading a selected product into the container. Product may be placed into the resulting assembled container by either the product manufacturer, the wholesaler, or the retailer. After the product is loaded into the container, the container may either be ready for shipment and/or for display or may have portions of the container needing to be removed in order to be ready for display.

The container may have a top that is to be closed and sealed by sequentially overlapping the top panels or by a different overlapping of the top panels along with the use of tape or glue, for example, to adhere selective top panels to each other. This usually requires additional manual labor.

Based on the above, it would be advantageous if the container pre-assembly, and thus the container itself, could be manufactured using less material and constructed such that assembling or erecting the ultimate container would be essentially automatic using little or no manual labor and making the entire process simpler and easier.

Thus, the present disclosure relates to a dual use display tray/container pre-assembly and a resulting dual use display tray/container, as well as a method for manufacturing such a container pre-assembly and container wherein less material is used and erection of the container from the pre-assembly occurs automatically by using automatic erector equipment that simply opens the panels of the pre-assembly and seals the bottom panels and, if appropriate, any top panels.

The pre-assembly, and thus the container, are constructed from either a single blank or a plurality of blanks, each blank having a plurality of panels. Embodiments according to the present disclosure that are constructed from a plurality of blanks include, for example, a primary blank and a supplementary blank.

In accordance with illustrated embodiments of the present disclosure, a method of manufacturing a container and the resulting container, and a method of manufacturing a container pre-assembly and the resulting container pre-assembly, as well as the use of a single blank or a plurality of blanks that comprise the pre-assembly and the container, are disclosed herein. When the methods and the blank or blanks are utilized in accordance with the present disclosure, they result in the formation of container pre-assemblies by automatic erector, or pre-assembly formation, equipment. Such pre-assemblies are configured to be set-up or opened or erected into a container using automatic container-erector equipment such that upon the erection of the container, divider panels and other panels of a pre-assembly cooperate to automatically form a plurality of cells within an interior of the erected container and also may form a plurality of interior and exterior access windows. The cells are configured to store and display product and the exterior access windows provide one-, two-, or three-sided external access to those interior cells. The interior access windows provide internal access to those interior cells. Embodiments of the present disclosure may include an option, via perforations in panels, to provide none or one or more interior and/or exterior access windows.

The pre-assembly and container embodiments of the present disclosure provide a dual use display tray/container having at least the following key advantageous features: (1) a plurality of cells created by divider panels within the container for storing and displaying product, and the cells may be substantially equal in dimension; (2) one-, two-, or three-sided external access via container side panels to the product displayed/stored in the cells; (3) auto-erection of the pre-assembly into the display tray/container, resulting in ease of assembly and a minimum amount or virtual elimination of manual labor, the auto-erection being made possible by strategic placement of glue points that fix or adhere or secure selective panels of the container to each other thereby making it possible for automatic erector equipment to erect the container from the pre-assembly; (4) additional stacking strength of the assembled containers based upon the glue point placements that establish the divider panel connections and locations relative to other divider panels and/or to other panels, such as the side panels, of the container; (5) improved anti-nesting qualities based upon the location of the divider panels; and, (6) dual use of the container based upon the configuration of the container panels to create a plurality of cells for both shipping and displaying the product inside the container.

Referring to the key features noted above and the accompanying drawings (see FIGS. 1-52), embodiments 100, 200, 300, 400 and 500 of the present disclosure include the key feature of a plurality of divider panels (see panels B, O, Q in FIGS. 1-42 of embodiments 100-400 and panels B, ND, PD in FIGS. 43-52 of embodiment 500, the divider panels cooperate with each other and/or with the side and bottom panels of the container to create a plurality of cells ZC within the interior of the container. In each of the embodiments, one or more of the divider panels may be secured at both ends (thus, such divider panels are considered to be "fixed") and one or more of the divider panels may be considered to be at least partially floating (or, as at least partially fixed—but simply identified as "floating"), that is, secured at one end and not secured at the other end. This is shown, for example, in FIGS. 10 and 11 where divider panel O is at least partially floating because panel N is not secured to divider panel B while divider panel Q is considered to be fixed via panel R being secured to divider panel B. It is further noted that one end of divider panel B is secured via panel A being secured to panel E and another end of divider panel B is secured to panels C and G. The adhering, securing or fixing of the panels occurs, for example, via glue points Y.

Another of the key features relates to the plurality of external access windows ZE which are created in the dual use display trays/containers of embodiments 100, 200, 300 and 500 (without removable top panels), as shown in FIGS. 10, 21, 30 and 51, and embodiment 400 as shown in FIG. 40 (with removable top panels) that provide three-sided external access to product displayed or stored in cells ZC of the container.

Another of the key features relates to the location of the means for securing, adhering, or fixing one panel to another. The fixing means may be, for example, gluing, as shown herein, or its equivalent. Those gluing or adhering points, are shown, for example, as glue points (Y). For panels that are glued together, the glue points (Y) may be on either or both of the respective panels to be secured to one another. The location of the glue points (Y) relative to the divider panels determines whether a particular divider panel is considered to be fixed or is considered to be at least partially floating. The word "floating" may be used herein to mean "at least partially floating".

Regarding the key features of improved stacking strength, improved anti-nesting qualities, and dual use capability, these features are created by a combination of the location of the divider panels (internally to the container), the location of the glue points Y joining the divider panels together and/or to other panels of the container, the creation of the plurality of cells by cooperation of the divider panels and other panels of the container, and the creation of cut-outs, or openings, or access windows ZI, ZE, in the divider and side panels of the container, respectively, the external access windows ZE providing, for example, at least one-sided external access to product in the cells ZC. The erected container is thus configured for dual use—as a display tray and shipping container, as shown in the embodiments 100-500 of FIGS. 1-52. Embodiment 400 includes a plurality of divider panels and cells but also includes a plurality of removable top panels forming a top for the container, as well as removable portions of the divider and side panels to form the internal ZI and external ZE access windows. Embodiment 400 is thus initially configured as a closed-top dual use tray/container which includes perforated sections of top and side panels enabling the removal of top panels and portions of the side panels to provide a dual use display tray with an open top and at least one-sided access to the plurality of internal cells ZC.

A more complete understanding of the embodiments of the present disclosure and the utility thereof may be acquired by referring to the following in consideration of the accompanying drawings and the description of the embodiments. Generally, in the drawings and the description, like reference numbers or letters indicate like features.

In the FIGS. 1-52, the solid lines shown separating or connecting various panels, end areas, panel portions, and tabs may be considered as fold lines, score lines, and/or hinge lines or edges. Perforated lines are shown as broken or dashed lines.

Other aspects of the present disclosure will become apparent from the following descriptions when considered in conjunction with the accompanying drawings.

BRIEF DESCRIPTION OF THE DRAWINGS

FIG. 12 illustrates a plan view of a primary blank used for manufacturing a container pre-assembly and a container in accordance with a second embodiment of a dual use tray/container, according to the present disclosure.

FIG. 13 illustrates a plan view of a supplementary blank used for manufacturing the container pre-assembly and container in accordance with the second embodiment of the dual use tray/container, according to the present disclosure.

FIGS. 34-42 illustrate perspective views of steps of manufacturing the container pre-assembly and container from the blanks of FIGS. 32 and 33 and showing the erection and location of divider panels, internal cells, side panels having perforated, removable portions configured to provide access windows, and perforated, removable top panels configured to create an open-top display tray, according to the present disclosure.

DETAILED DESCRIPTION

Figure 1:
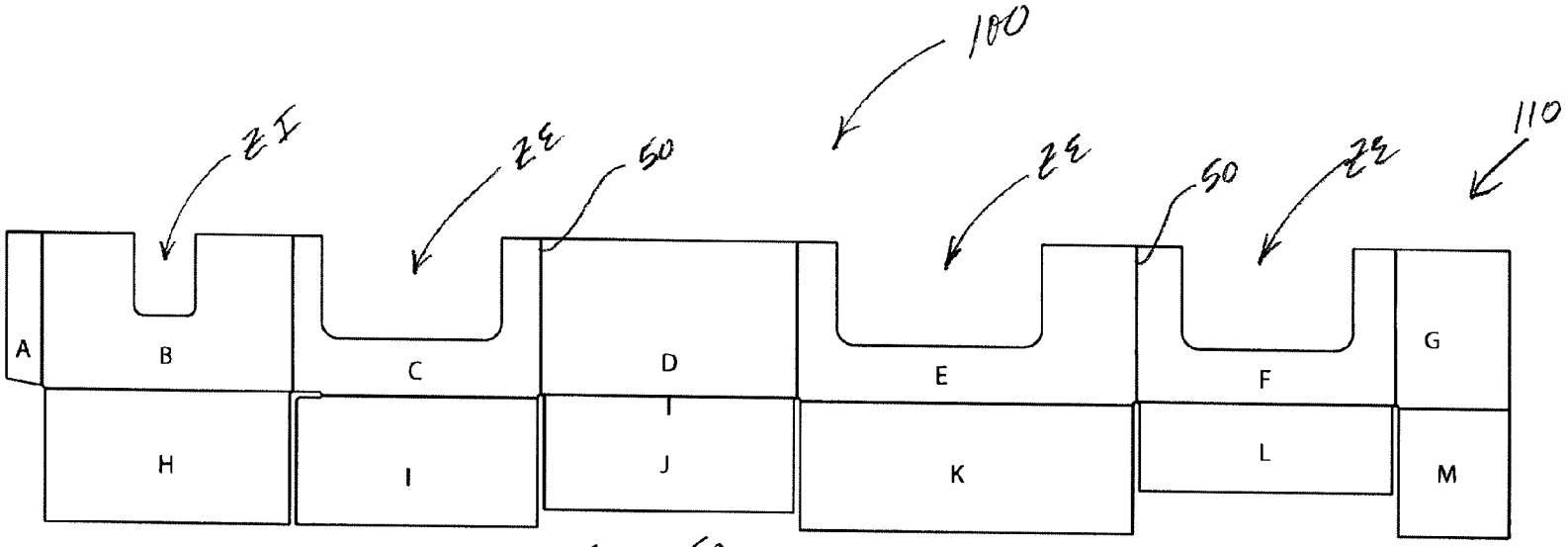
FIG. 1 illustrates a plan view of a primary blank used for manufacturing a container pre-assembly and a container in accordance with a first embodiment of a dual use tray/container, according to the present disclosure.
Figure 2:
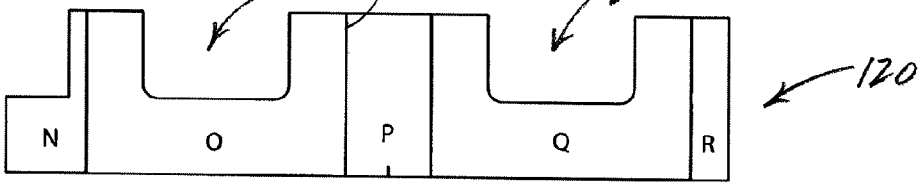
FIG. 2 illustrates a plan view of a supplementary blank used for manufacturing the container pre-assembly and container in accordance with the first embodiment of the dual use tray/container, according to the present disclosure.
Figures 3, 4, 5:
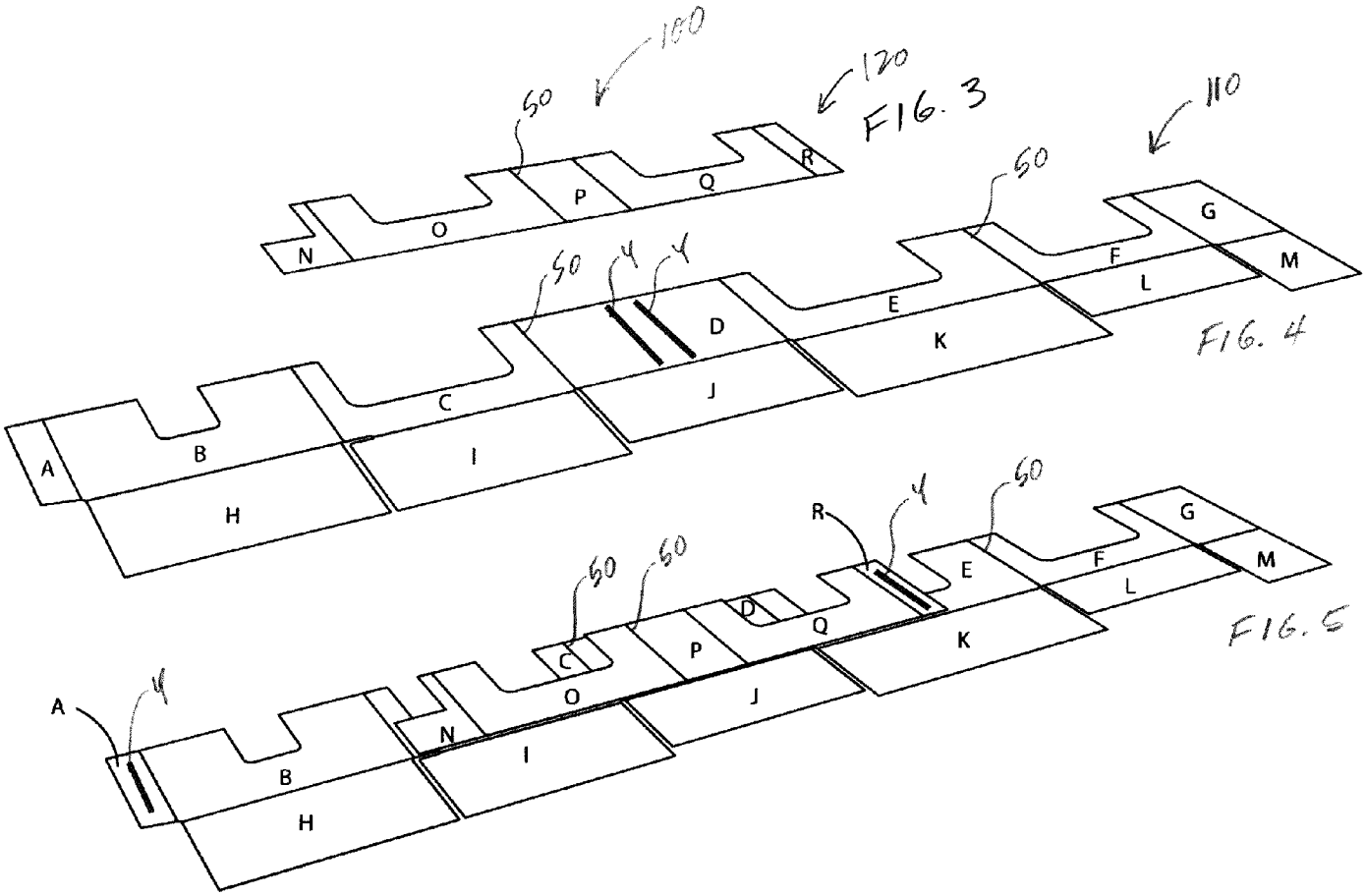
FIGS. 3-11 illustrate perspective views of steps of manufacturing the container pre-assembly and container from the blanks of FIGS. 1 and 2 and showing the erection and location of divider panels, internal cells, and access windows, in accordance with the present disclosure.
Figure 6:
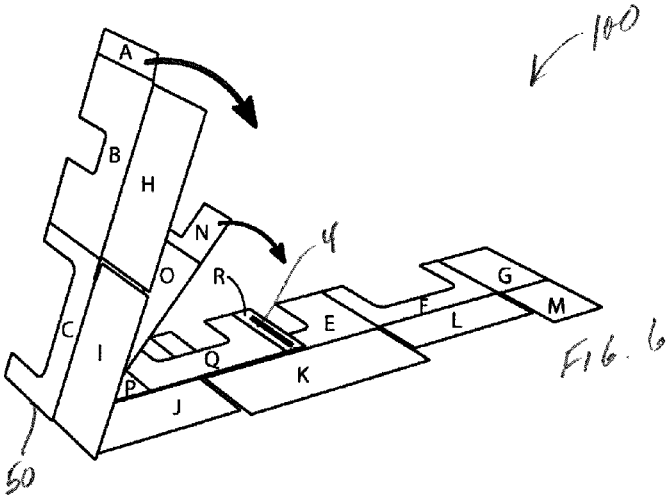
Figure 7:
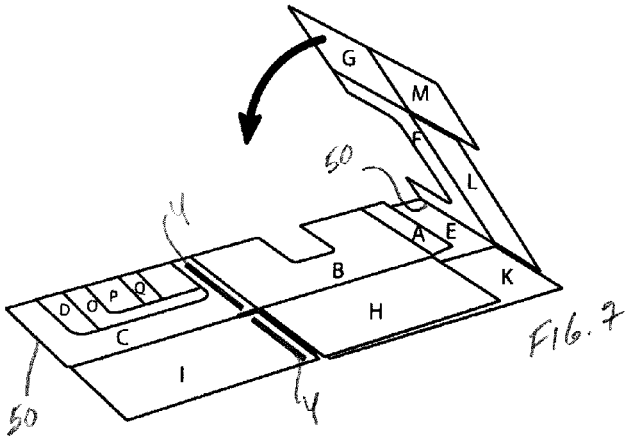
Figure 8:
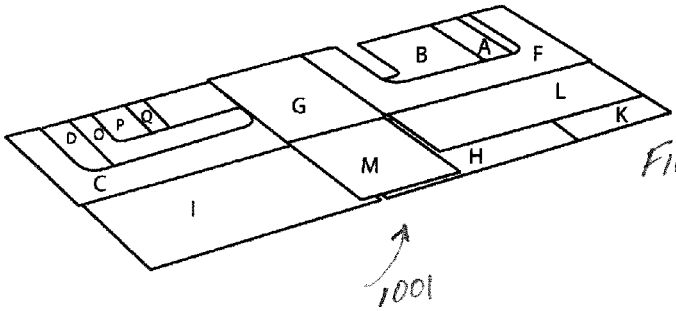

In the following description of embodiments in accordance with the present disclosure, reference is made to the accompanying drawings. It is to be understood that other embodiments, in accordance with the present disclosure, may be utilized and structural and functional modifications may be made without departing from the scope and spirit of the embodiments of the present disclosure presented herein.

The manufacture and use of containers that may be used for more than one purpose, e.g., for transport of product and subsequent display of product in a retail environment, are becoming more in demand among both manufacturers and retailers because such containers enable a reduction or minimization of the amount of container material while increasing or maximizing the amount of display space available for product. Thus, it is known that a blank or blanks, used to manufacture containers, for example, are made from some type of paperboard and/or other material that is die-cut and scored for subsequent manipulation to form a pre-assembly. The pre-assembly, for example, is a partially assembled container wherein the blank, or blanks, is/are manipulated and affixed to itself, or to each other. The pre-assembly is usually in a flat or knock-down form and is not finally erected or assembled into a container until later. Such a container, for example, called packaging, or a carton, or a box, etc., is made from the pre-assembly. Such a container may enable product to be transported to a retail environment and then the product may then be displayed in the retail environment within the transporting container but with manual modification of the container required.

The durability, strength and stackability of such a packaging or container has often required increasing the amount of material content within the container. However, further reducing the amount of material content in the manufacturing of a container has become a significant goal of many manufacturers and retailers because of the adverse effect the extra material has on landfills and the environment in general, as well as the cost of manufacturing, transporting and disposing of such a container.

Thus, both manufacturers and retailers are recognizing a need to not only reduce the number of different types of containers used to provide product to an end-consumer in a retail supply chain, such as providing one container for transport and another for display but also to provide a cost effective dual use container.

Thus, one mechanism for reducing the number of containers necessary to provide product to potential consumers in a retail environment is by providing a dual-use container wherein the container can be used both to store product during transport and then be used to display the product once that product has arrived in the retail environment.

Further, in an effort to use available space in the retail environment, retailers may be interested in using the display function of such a dual-use container in a manner such that multiple containers may be stacked on top of one another to improve or optimize vertical space utility in the retail environment. Simply put, having the ability to be able to stack display containers enables a store operator to present more product and/or different types of product in a manner that a customer can see and have access from multiple directions. For example, by providing the opportunity to safely stack such containers, for example, dual use display trays, on a counter, a store operator is able to increase the use of counter space such that more than one display tray can occupy the same horizontal counter footprint. As is understood in the retail industry, such a configuration increases sales because customers are able to see more available product and product types for sale.

However, a problem with stacking such display and shipping containers, whether such containers are dual-use transporting/display tray/containers or otherwise, is that the weight of the container(s) in combination with the weight of the product(s) stored in the container(s) can cause one or more containers to be damaged or collapse. As a result, a store operator is left with damaged, ineffective or completely non-functioning display container(s), which causes operational problems and reduces the likelihood of sales to consumers.

Accordingly, based on all of these factors, there is a need to provide a method of manufacturing a reduced-material content container and its associated pre-assembly from a single blank or plurality of blanks, which, when properly constructed, result in an erected container that has significantly improved stacking strength and anti-nesting characteristics over conventional containers, whether dual use or not. Thus, the pre-assemblies and containers of the present disclosure provide for dual use, both as a transporting container for transporting product to a retail environment and as a display container, such as a tray, configured to display and provide access to the product in that retail environment.

The embodiments of the present disclosure advance the efforts to: conserve natural resources; reduce the impact on the environment; improve efficiency by reducing the time it takes to erect a container by using automated erector equipment, thereby reducing the number of human touches it takes to erect the container; and, reduce costs associated with product manufacture and sale. In the past, various initiatives have been put in place by both suppliers and retailers to reduce the overall number of product containers and display tray and the materials used therein. The present disclosure, including the embodiments described and shown herein, addresses each of these efforts.

Embodiments of the dual use display tray/container, according to the present disclosure, are constructed either 1) from a combination of an individual primary blank (generically identified with numerical designation 10 as a suffix) and an individual supplementary blank (generically identified with numerical designation 20 as a suffix) (see embodiments 100, 200, 400 and 500), or, 2) from a single, combination blank 330 (see embodiment 300), which blank 330 essentially combines the features of the primary blank 10 and the supplementary blank 20. Thus, the primary blanks of embodiments 100, 200, 400 and 500 are identified specifically as 110, 210, 410 and 510, respectively, and the combination blank of embodiment 300 is identified as 330.

Primary blanks 110, 210 and 510 of embodiments 100, 200 and 500 include a plurality of side panels C, D, E, F and G, a plurality of bottom panels H, 1, J, K, L and M (except for embodiment 500 which excludes bottom panel M), and a divider panel B having an extension panel A extending therefrom.

Primary blank 410 of embodiment 400 includes a plurality of side panels C, D, E, F and G, a plurality of bottom panels H, I, J, K, L, M, a divider panel B having an extension panel A extending therefrom, and a plurality of top panels S, T, U, V, W and X, which top panels are configured to be detachably connected to respective side panels by perforations 40 shown as broken lines. Perforations 40 in the side panels and divider panels provide for options whether or not to create internal and/or external access windows ZI, ZE, respectively.

Supplementary blank 20 of embodiments 100, 200 and 400 includes divider panels O and Q and extension panels N, P and R extending from one or more of divider panels O and Q, and which extension panels N, P and R are configured to either be secured to one of the side panels B-G or to, for example, divider panel B.

Supplementary blank 20 of embodiment 500 includes a plurality of divider panels ND, O and PD and extension panels ME and QE extending from divider panels ND and PD, respectively.

Combination blank 330 of embodiment 300 includes a plurality of side panels C, D, E, F and G, a plurality of bottom panels H, I, J, K, L and M, a plurality of divider panels B, O, Q and a plurality of extension panels A, N, P and R extending from one or more of divider panels B, O and Q. Divider panels O and Q and extension panel P are configured to extend from side panel D.

The divider panels, according to the present disclosure, may be secured or fixed at both ends, for example, divider panels B and Q in embodiments 100, 300 and 400, divider panel B in embodiment 200, and divider panels B and ND in embodiment 500. The divider panels may be at least partially floating (or identified as "floating" herein), that is fixed or secured at one end and not fixed or secured at the other end. See, for example, divider panel O in embodiments 100, 300 and 400, divider panels O and Q in embodiment 200, and extension panel QE extending from divider panel PD in embodiment 500. Or, the divider panels may be fixed, that is secured at both ends. See, for example, divider panels B and Q in embodiments 100, 300 and 400, divider panels B and ND in embodiment 500, and divider panel B in embodiment 200.

The divider panels, according to the present disclosure, may include cut-outs or access windows ZI formed during manufacturing. Or, the divider panels, according to the present disclosure, may include perforations 40 outlining the shape of the cut-outs or access windows ZI to be created by removal of a portion of the divider panels after erection of the container at a manufacturer's, wholesaler's or retailer's location, for example. The cut-outs or access windows ZI allow for internal access to product stored in cells ZC formed in an interior 80 of the container, which cells ZC are created by a combination of the side panels, the bottom panels and the divider panels of the containers (see below). The discussion herein regarding cells ZC may only refer to them being formed by divider panels and side panels for ease of discussion. It is recognized that the bottom panels also cooperate to form the cells ZC.

For external access to internal cells ZC, such as to product stored in those cells ZC, the side panels C, E and F of embodiments 100-400 and the side panels D, E and F of embodiment 500 are provided with external access windows ZE. Such access windows ZE may be completely formed on their respective panels during manufacture of the blank or blanks or may be partially formed, or outlined, with perforations 40 on their respective blank or blanks during manufacture of the blank or blanks. The perforations 40 allow for the access windows ZE to be fully formed or created upon or after, for example, erection of the container by removing material along the perforations 40. For example, embodiments 100, 200, 300 and 500 include access windows ZE already cut-out of their respective side panels whereas embodiment 400 includes side panels having perforations 40, shown as broken lines, permitting easy removal of a portion of the side panels to form the access windows ZE.

For access between and among internal cells ZC to, for example, product stored in the cells ZC, the divider panels B, O, Q in embodiments 100, 200, 300 and 400 include the access windows ZI. Access windows ZI in embodiments 100, 200 and 300 are formed at manufacturing of the blank or blanks and the access windows ZI in embodiment 400 may be formed by removing portions of the divider panels along the perforated lines 40 before or after erection of the container. In embodiment 500, the divider panels ND and PD include access windows ZI but divider panel B does not, for example, include an internal access window ZI. That is because the divider panels B, ND, PD are all formed, for example, substantially parallel to one another, unlike the other embodiments 100-400 where only two of the three divider panels are substantially parallel to one another. And, unlike the location of the divider panels in the other embodiments 100-400, divider panel B in embodiment 500 splits the access window ZE in side panel E thereby providing external access to cells ZC on either side of divider panel B, which cells ZC are formed by, respectively, side panel E and divider panels B and ND, and side panel E and divider panels B and PD.

Figure 9:
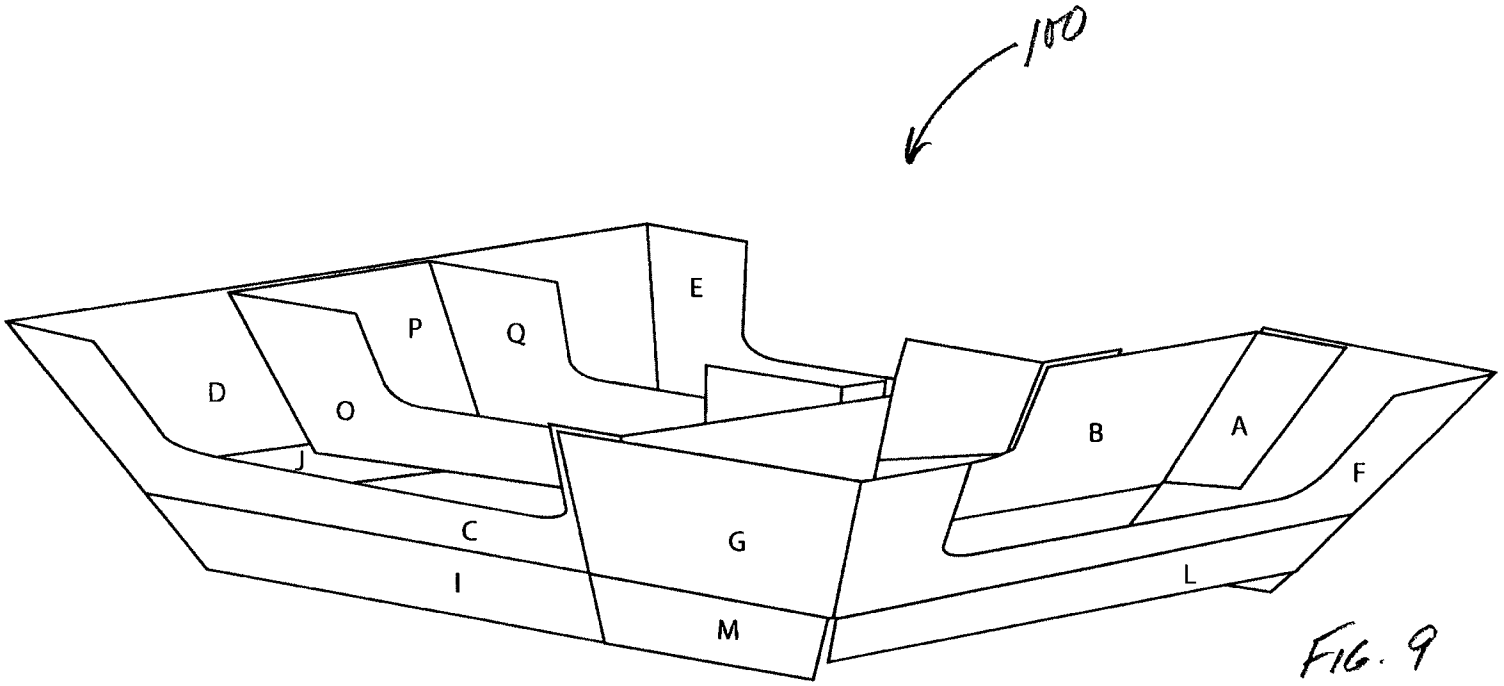

A first embodiment 100 (see FIGS. 1-11) includes a primary blank 110 and a supplementary blank 120 which are combined, for example, by gluing side panel D to extension panel P via glue points Y to ultimately form a pre-assembly 1001 by folding selected panels along fold lines 50 and via further glue points Y, as shown sequentially in FIGS. 3-8 (see arrows 60). Pre-assembly 1001 is automatically erected into dual use display tray/container 1010, as suggested or shown in FIGS. 9, 10 and 11 by using, for example, automated erector equipment (not shown), to move the side, bottom, extension, and divider panels to an opened configuration and then securing selected bottom panels to each other to finish the erection of the dual use display tray/container 1010.

Figure 10:
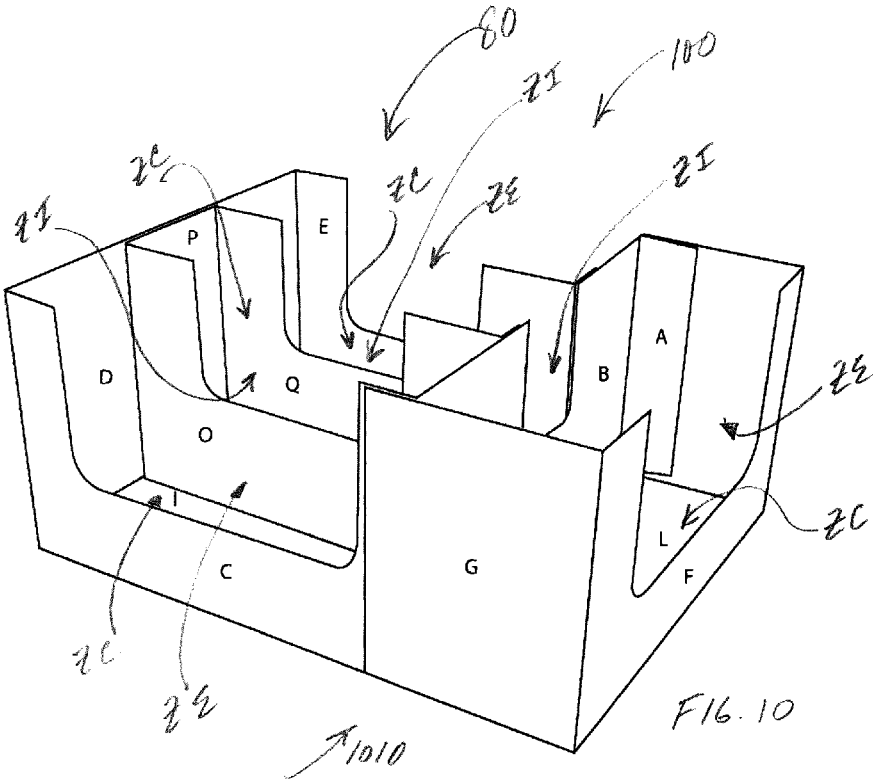
Figure 11:
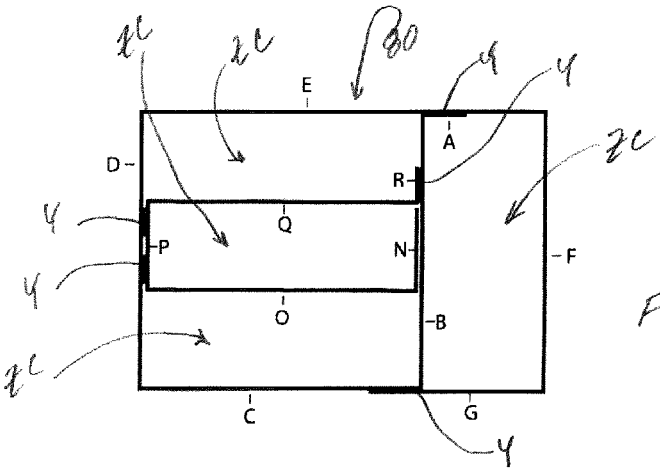
Figures 14, 15, 16:
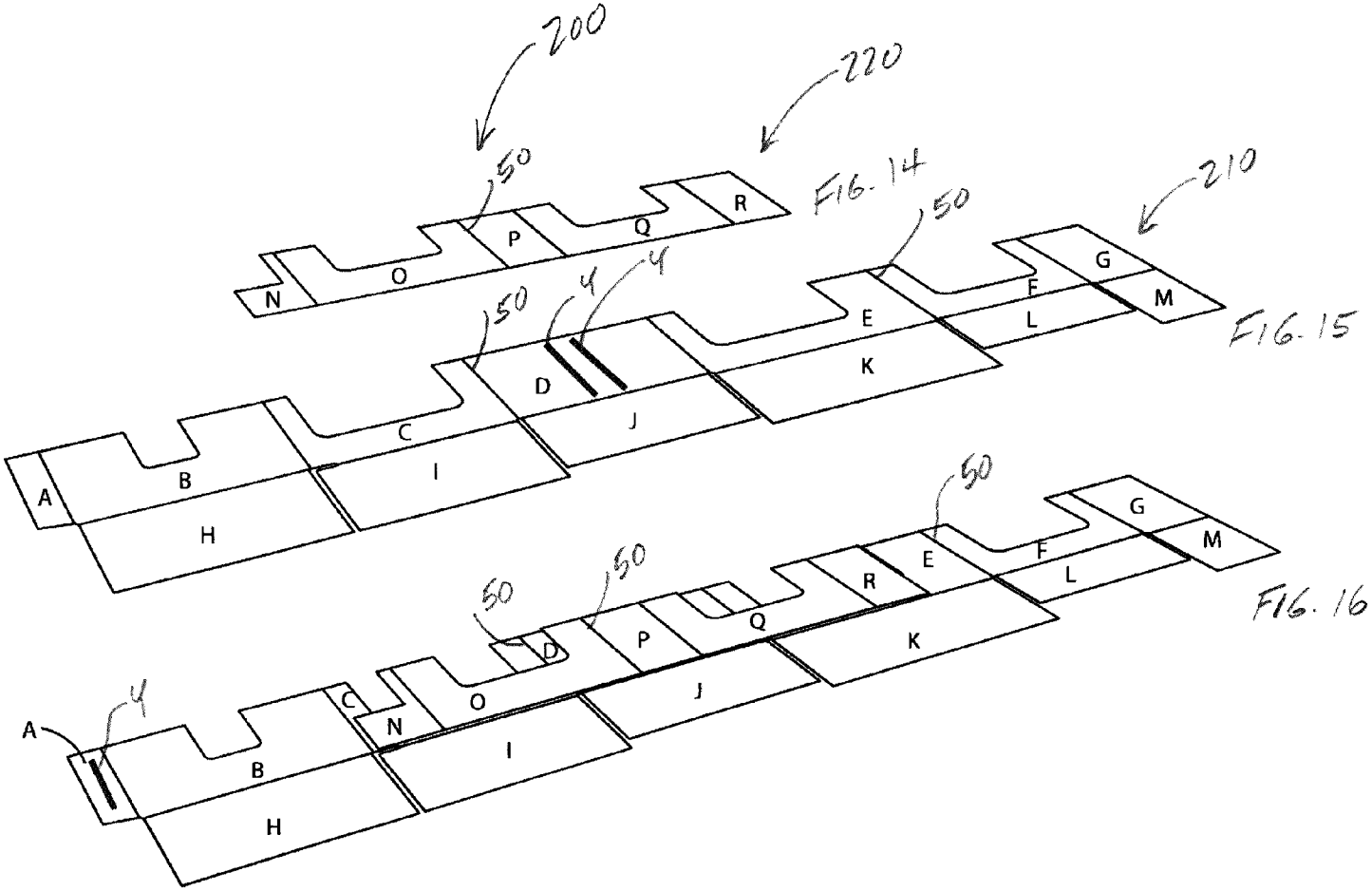
FIGS. 14-22 illustrate perspective views of steps of manufacturing the container pre-assembly and container from the blanks of FIGS. 12 and 13 and showing the erection and location of divider panels, internal cells, and access windows, in accordance with the present disclosure.
Figure 17:
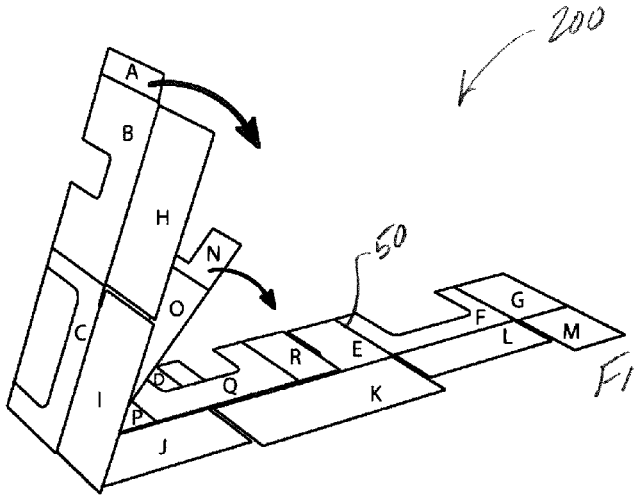
Figure 18:
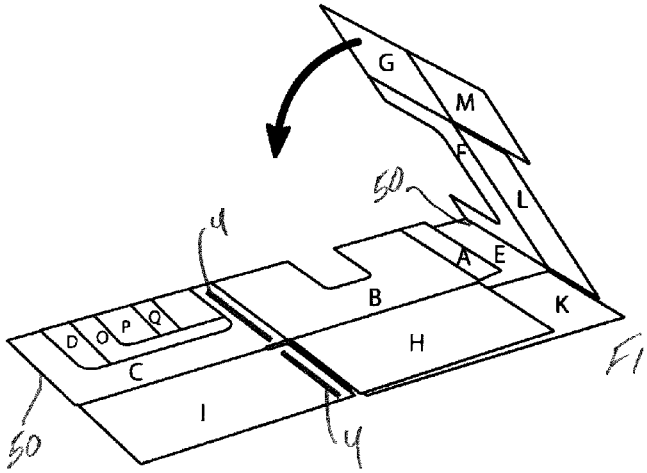
Figure 19:
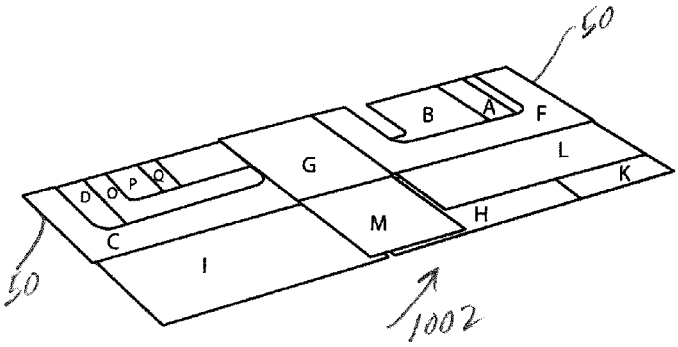

As shown in FIGS. 10 and 11, dual use display tray/container 1010 includes cells ZC formed in the interior 80 by divider panels B, O and Q and side panels C-G, wherein divider panels B and Q are fixed or secured at glue points Y and divider panel O, while secured at glue points Y via extension panel P, is configured to be floating since extension panel N is not secured to divider panel B. Divider panels O and Q are shown substantially parallel to one another while divider panel B is substantially orthogonal to divider panels O and Q. Cells ZC are substantially equal in dimension to one another.

Figure 20:
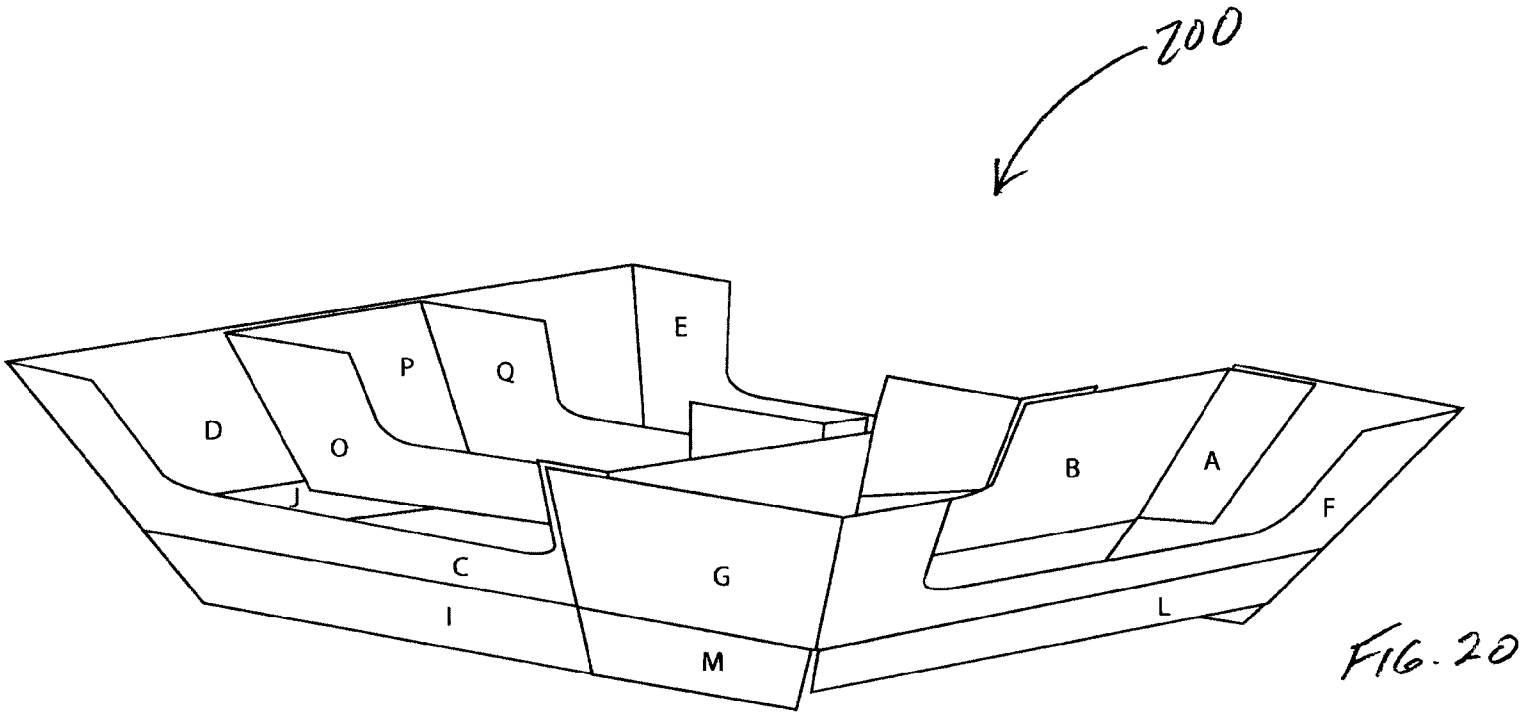

A second embodiment 200 (see FIGS. 12-22) includes a primary blank 210 and a supplementary blank 220 which are combined, for example, by gluing side panel D to extension panel P via glue points Y to ultimately form a pre-assembly 1002 by folding selected panels along fold lines 50 and via further glue points Y, as shown sequentially in FIGS. 14-19 (see arrows 60). Pre-assembly 1002 is automatically erected into dual use display tray/container 1020, as suggested or shown in FIGS. 20, 21 and 22 by using, for example, automated erector equipment (not shown) to move the side, bottom, extension, and divider panels to an opened configuration and then securing selected bottom panels to each other to finish the erection of the dual use display tray/container 1020.

Figure 21:
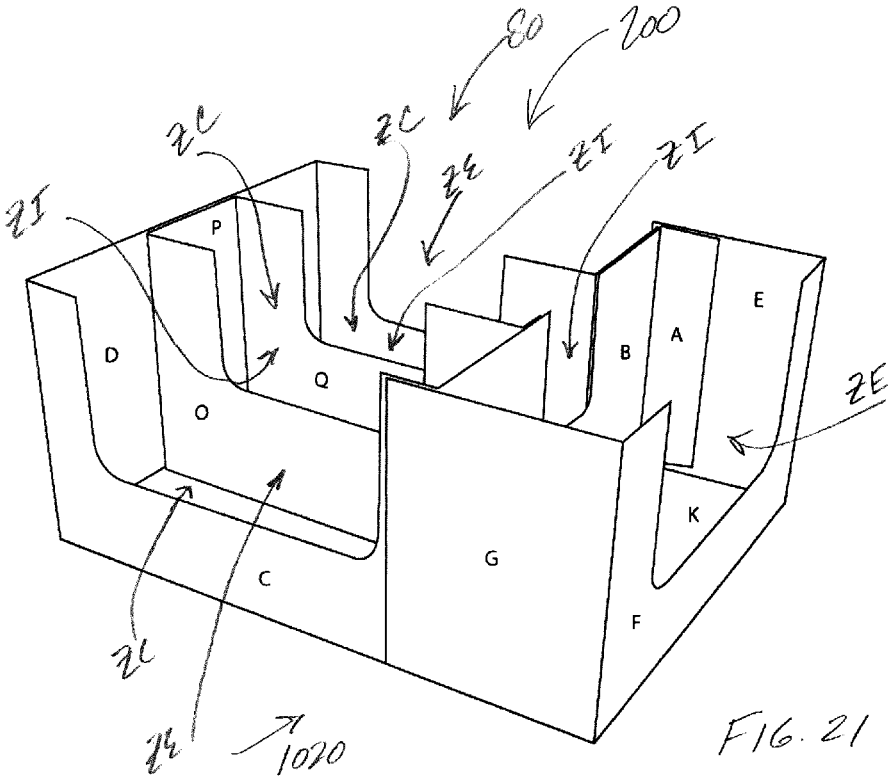
Figure 22:
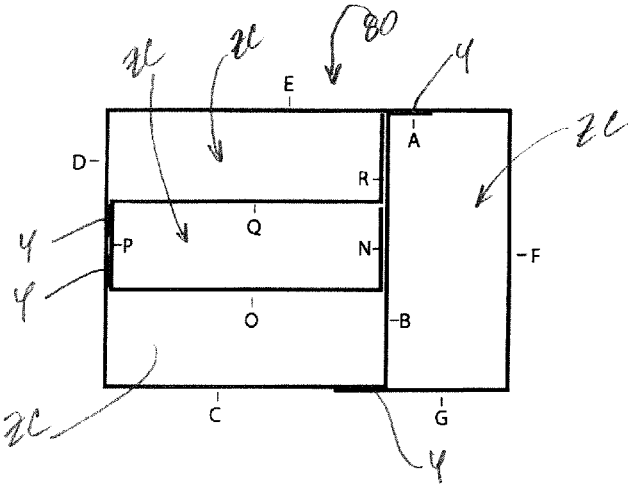
Figure 23:
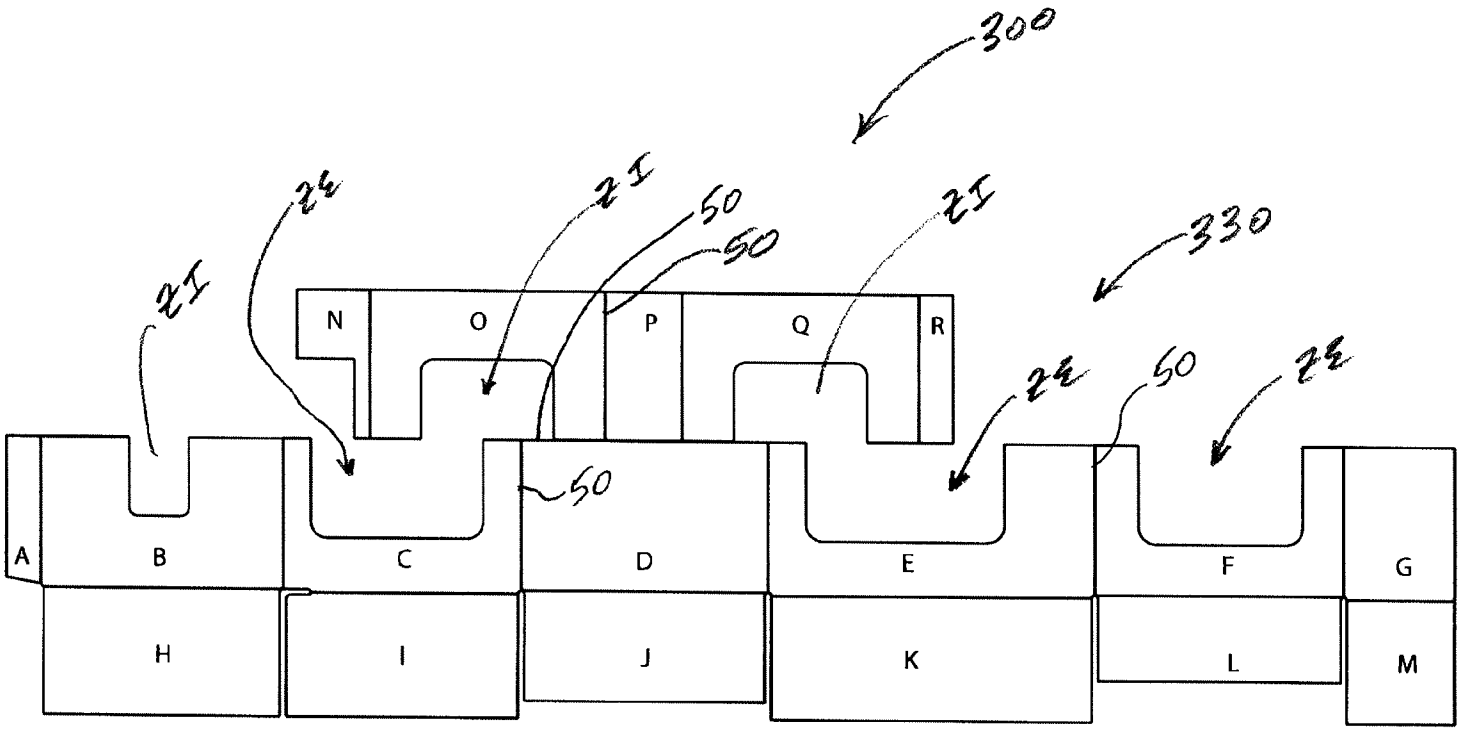
FIG. 23 illustrates a perspective view of a primary blank used for manufacturing a container pre-assembly and a container in accordance with a third embodiment of a dual use tray/container, according to the present disclosure.
Figure 24:
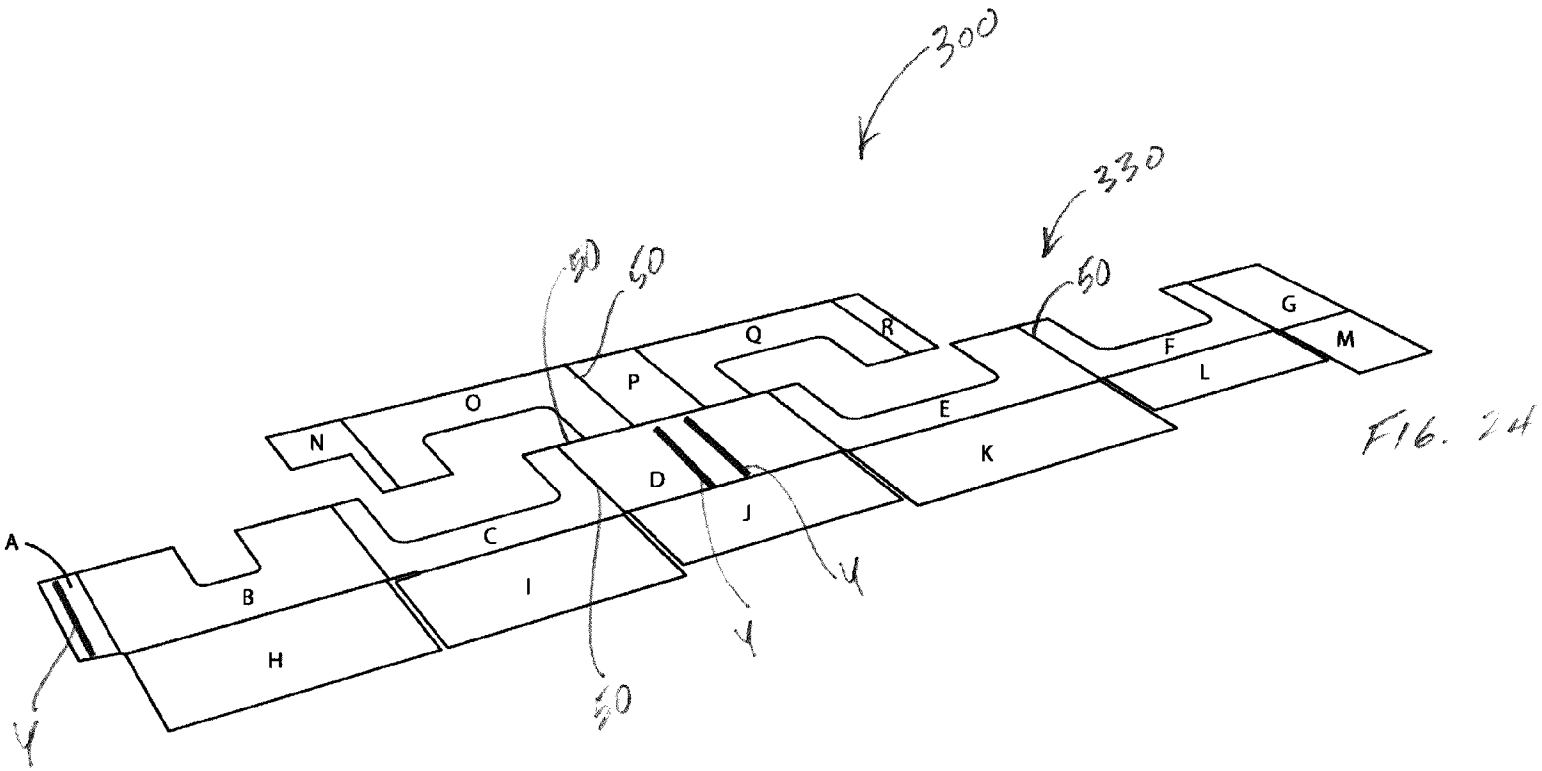
FIGS. 24-31 illustrate perspective views of steps of manufacturing the container pre-assembly and container from the blank of FIG. 23 and showing the erection and location of divider panels, internal cells and access windows, according to the present disclosure.
Figure 25:
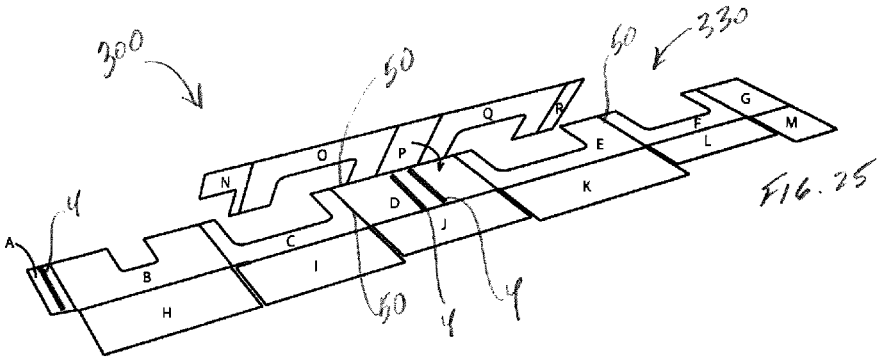
Figure 26:
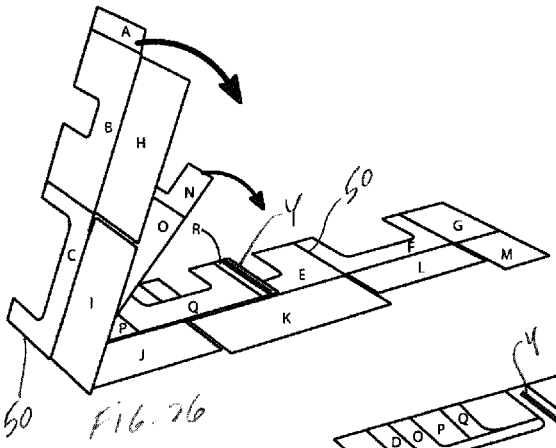
Figure 27:
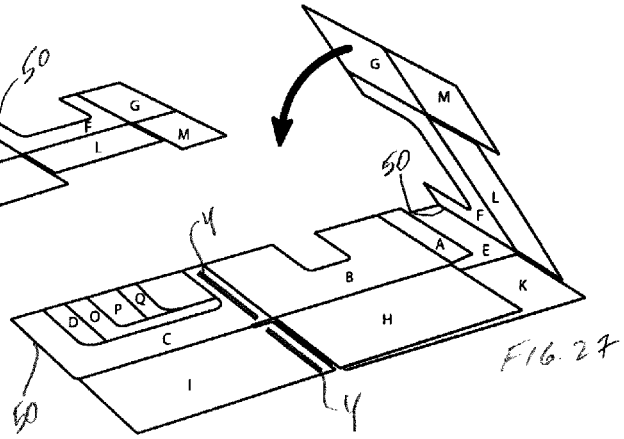
Figure 28:
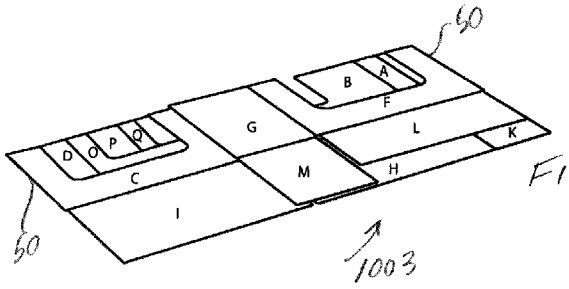

As shown in FIGS. 21 and 22, dual use tray/container 1020 includes cells ZC formed in the interior 80 by divider panels B, O and Q and side panels C-G, wherein divider panel B is fixed at glue points Y and divider panels O and Q, while secured via glue points Y via extension panel P to side panel D, are configured to be floating since extension panels N and R are not secured, or glued, to divider panel B. Divider panels O and Q are shown substantially parallel to one another while divider panel B is substantially orthogonal to divider panels O and Q. Cells ZC are substantially equal in dimension to one another.

Figure 29:
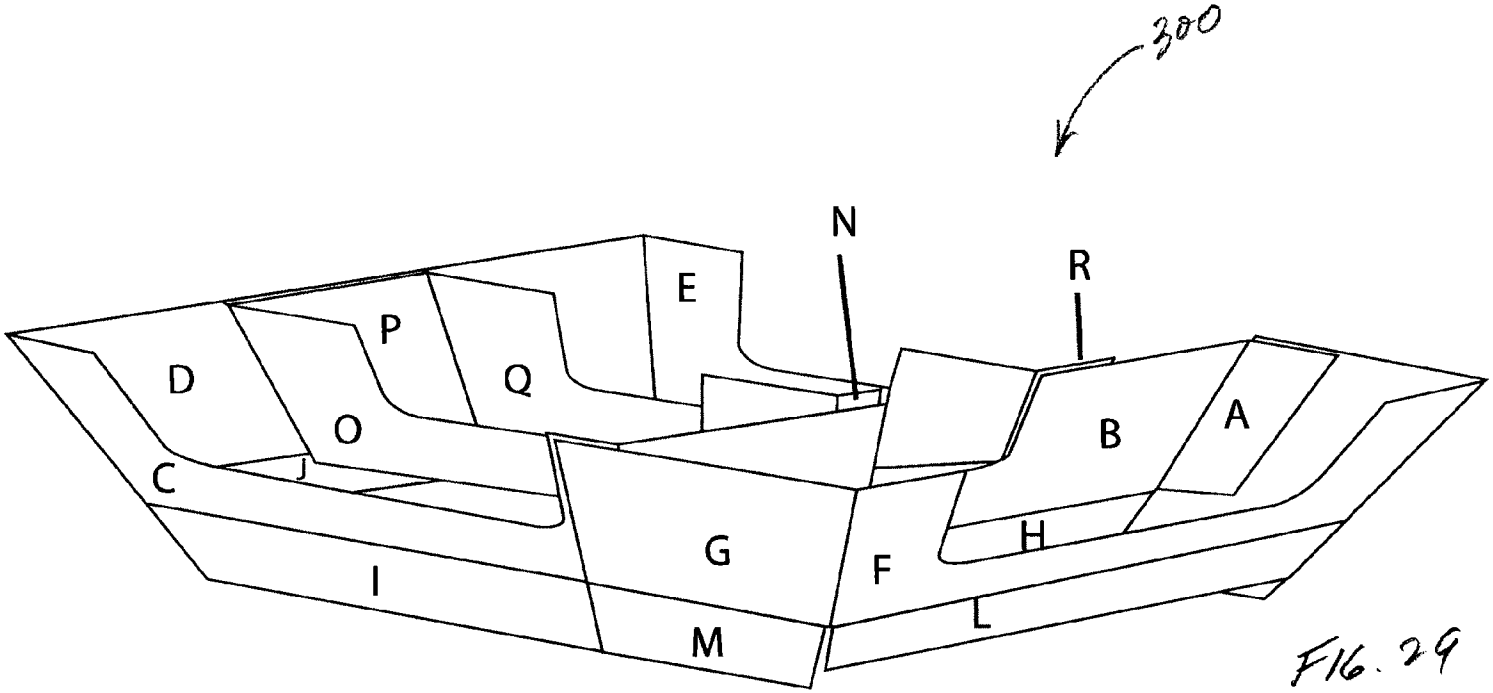

A third embodiment 300 (see FIGS. 23-31) includes a combination blank 330 that is manufactured as a single blank and includes essentially the same panels as in the primary and supplementary blanks 110, 210, respectively, of embodiment 100. Extension panel P is formed integrally with side panel D, thereby forming a double wall. That is similar to the double wall formed in other embodiments when the primary and supplementary blanks are secured or glued to each other at, for example, side panel D and extension panel P. In this embodiment 300, divider panels O and Q and extension panel P are folded along fold line 50 and side panel D is glued to extension panel P via glue points Y to ultimately form a pre-assembly 1003 by folding selected panels along fold lines 50 and via further glue points Y, as shown sequentially in FIGS. 24-28 (see arrows 60). Pre-assembly 1003 is automatically erected into dual use display tray/container 1030, as suggested or shown in FIGS. 29, 30 and 31, by using, for example, automated erector equipment (not shown) to move the side, bottom, extension, and divider panels to an opened configuration and then securing selected bottom panels to each other to finish the erection of the dual use display tray/container 1030.

Figure 30:
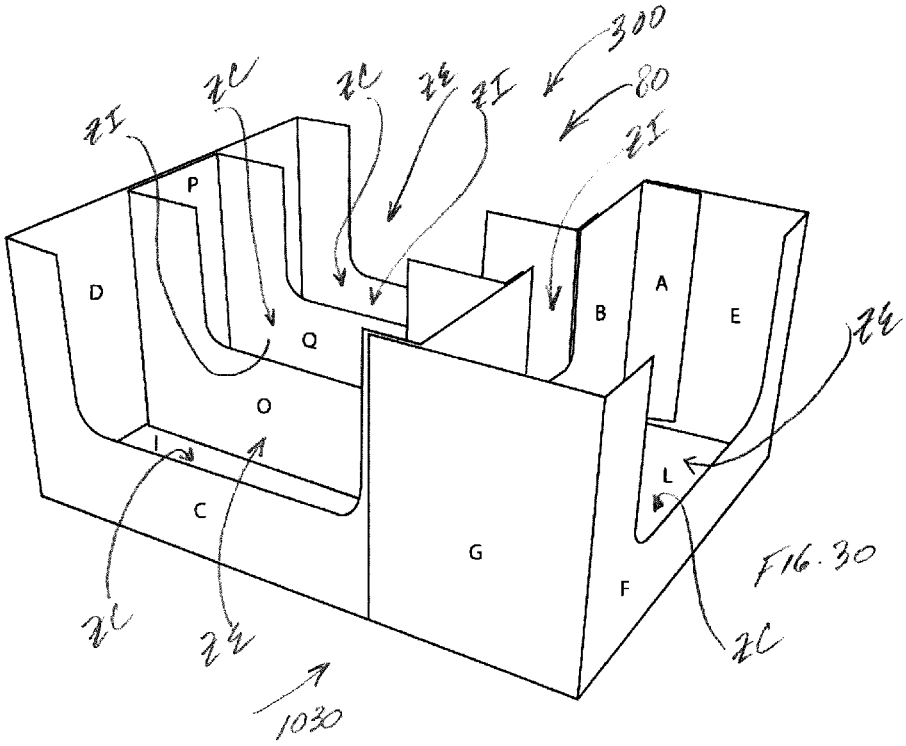
Figure 31:
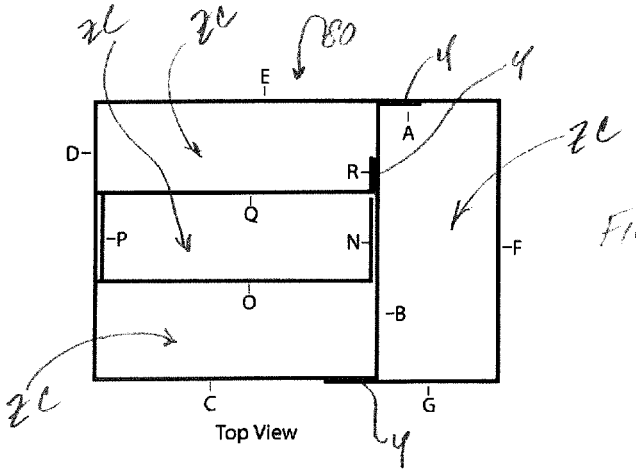
Figure 32:
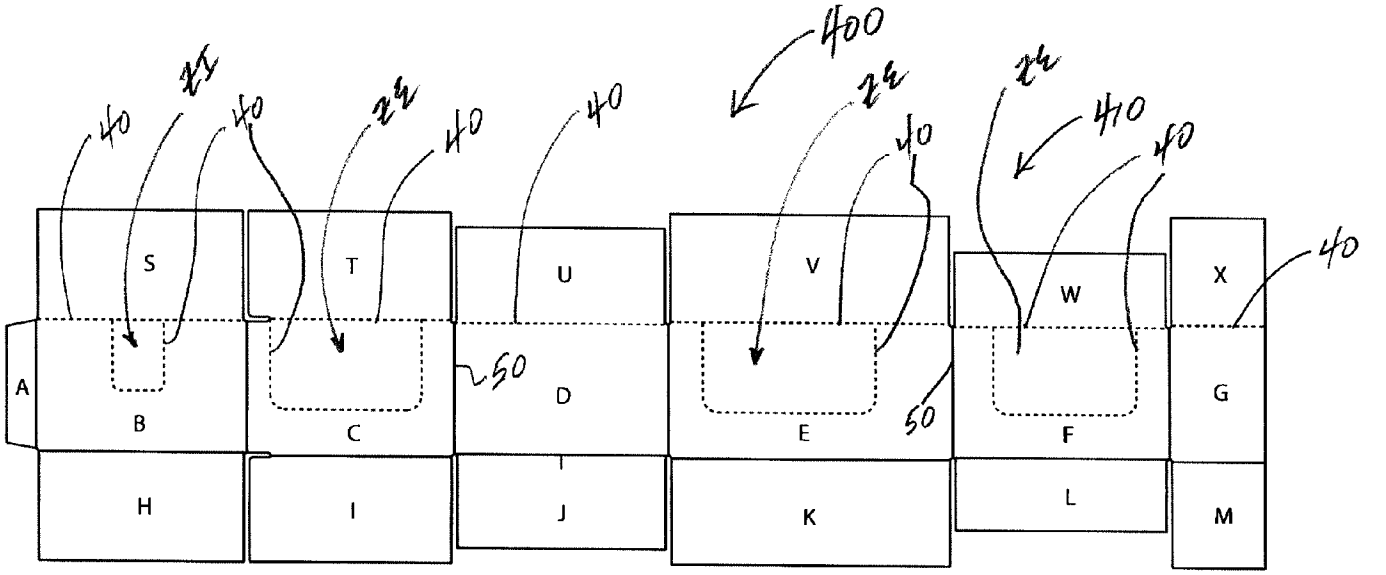
FIG. 32 illustrates a plan view of a primary blank and for manufacturing a container pre-assembly and a container in accordance with a fourth embodiment of a dual use tray/container, according to the present disclosure.
Figure 33:
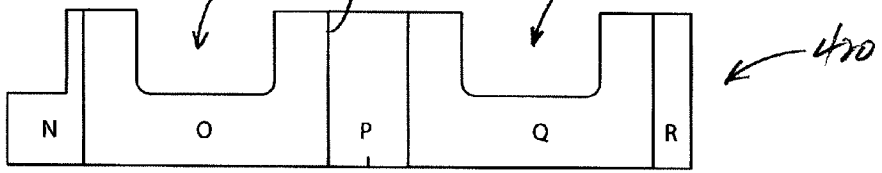
FIG. 33 illustrates a plan view of a supplementary blank used for manufacturing the container pre-assembly and container in accordance with the fourth embodiment of the dual use tray/container, according to the present disclosure.
Figures 3A, 3B, 3C:
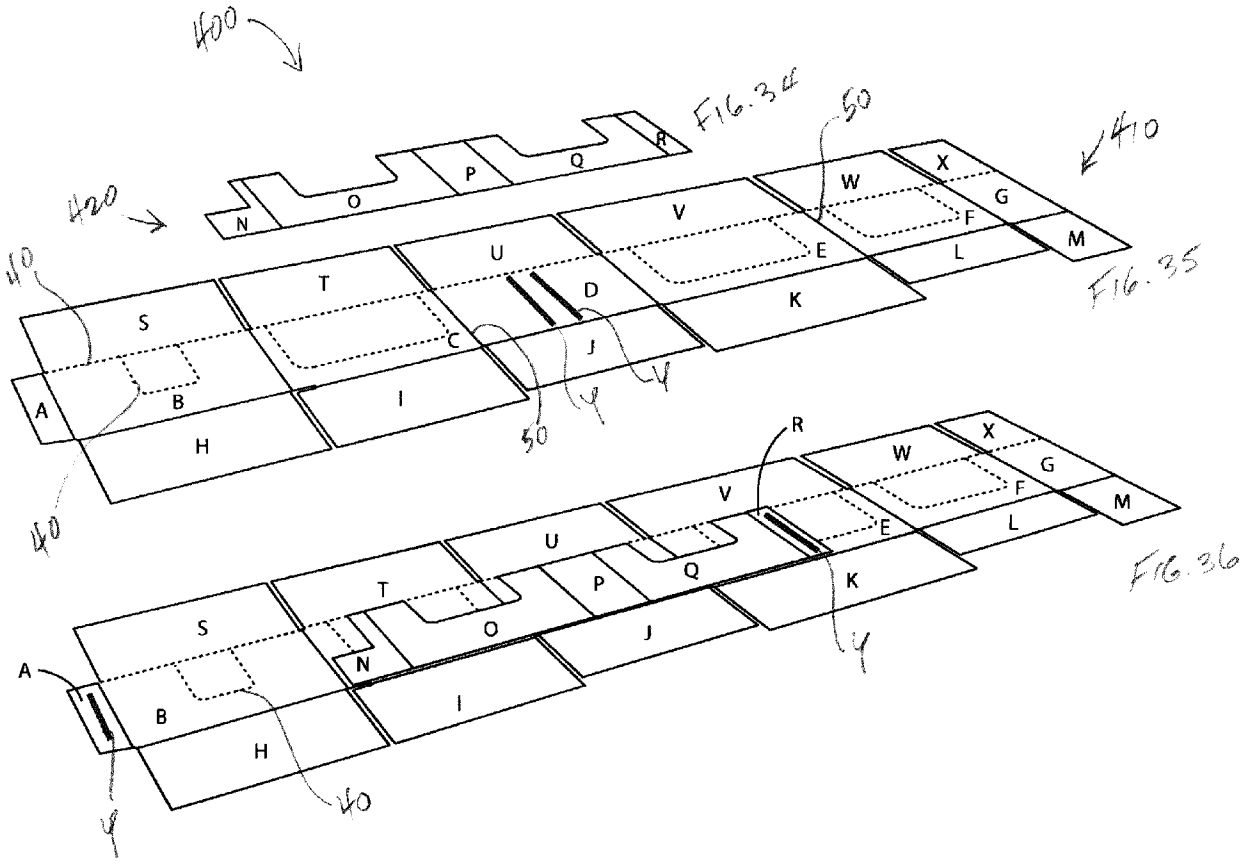
Figure 37:
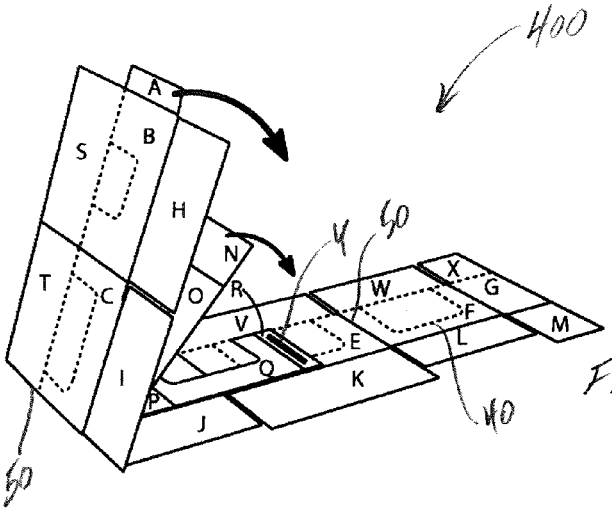
Figure 38:
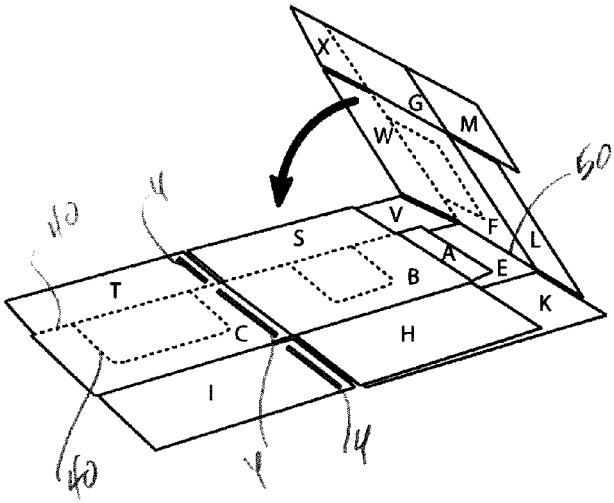
Figure 39:
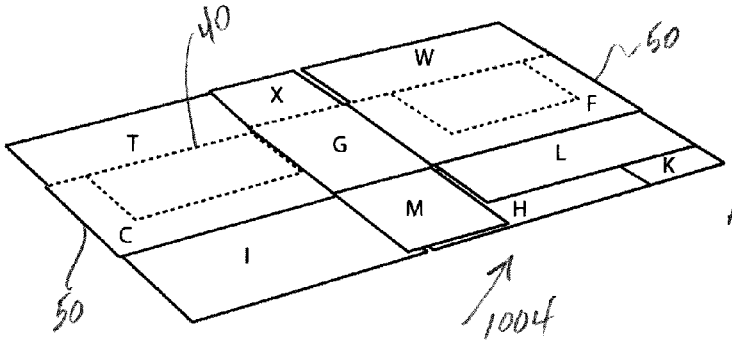

As shown in FIGS. 30 and 31, dual use display tray/container 1030 includes cells ZC formed in the interior 80 by divider panels B. O and Q and side panels C-G, wherein divider panels B and Q are fixed or secured at glue points Y and divider panel O, while secured at glue point Y via extension panel P, is configured to be floating since extension panel N is not secured to divider panel B. Divider panels O and Q are shown substantially parallel to one another while divider panel B is substantially orthogonal to divider panels O and Q. Cells ZC are substantially equal in dimension to one another.

Figure 40:
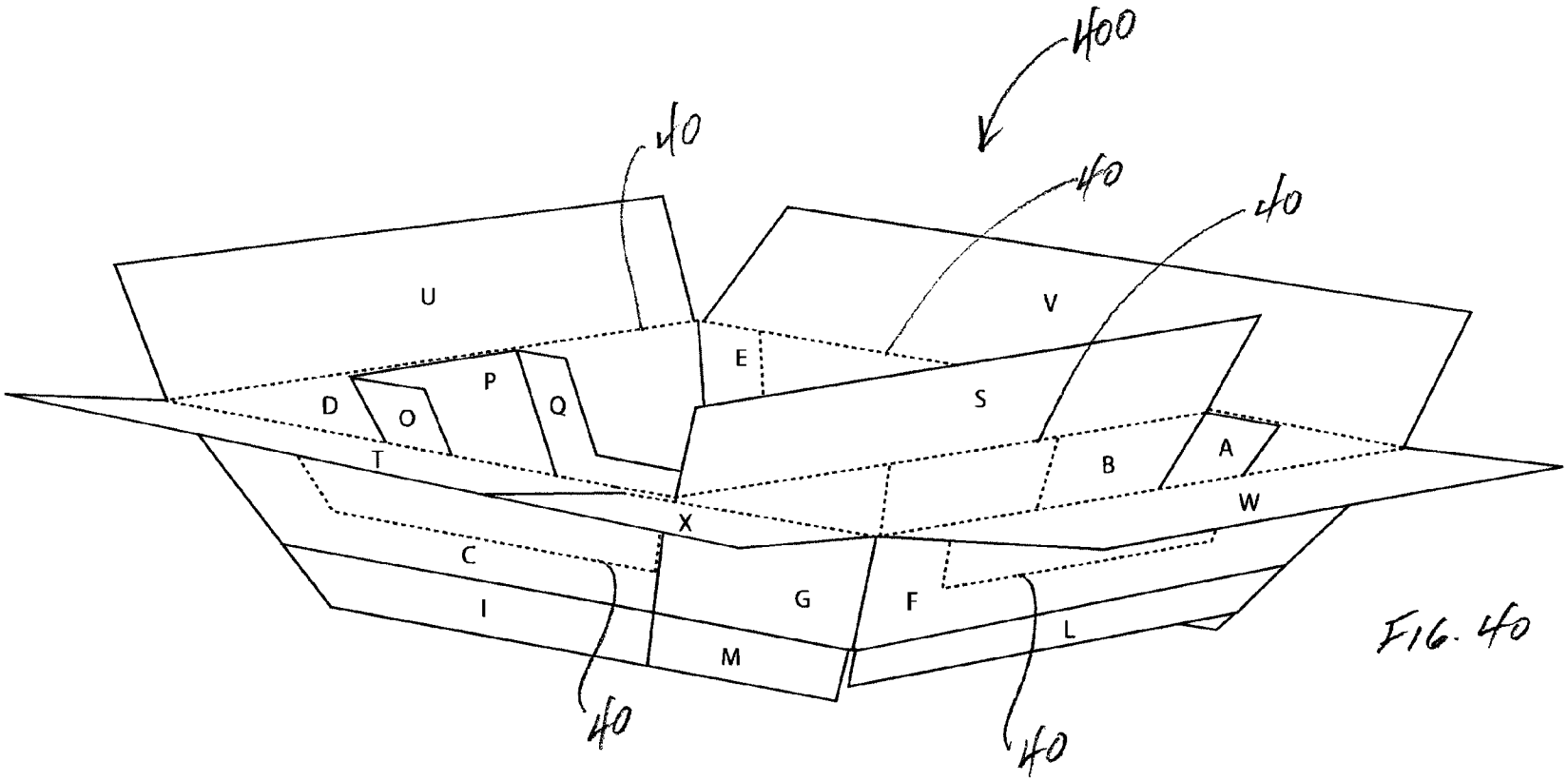

A fourth embodiment 400 (see FIGS. 32-42) includes a primary blank 410 and a supplementary blank 420 which are combined, for example, by gluing side panel D to extension panel P via glue points Y to ultimately form a pre-assembly 1004 by folding selected panels along fold lines 50 and via further glue points Y, as shown sequentially in FIGS. 34-39 (see arrows 60). Embodiment 400 differs, for example, from embodiment 100 in that embodiment 400 includes top panels S, T, U, V, W and X that are connected to divider panel B and side panels C, D, E, F and G via perforated lines 40. In addition, access window ZI in divider panel B and access windows ZE included in side panels C, E and F are identified or outlined and partially formed by perforated lines 40. Thus, top panels S, T, U, V, W and X are configured to be separated along the perforated lines 40 (see arrows 70) from their respective divider or side panels, and access windows ZI and ZE are configured to be completely formed by removing portions of divider panel B and side panels C, E and F along perforated lines 40 to form an open-top, dual use display tray/container 1040 similar to 1010 in FIG. 10 of embodiment 100, as suggested or shown in FIGS. 40, 41 and 42 of embodiment 400.

As suggested above, embodiment 400 includes a removable top (panels S-X) and sealed-off external access windows ZE to provide an alternative shipping container that can ultimately be converted to dual use display tray/container 1040.

Figure 41:
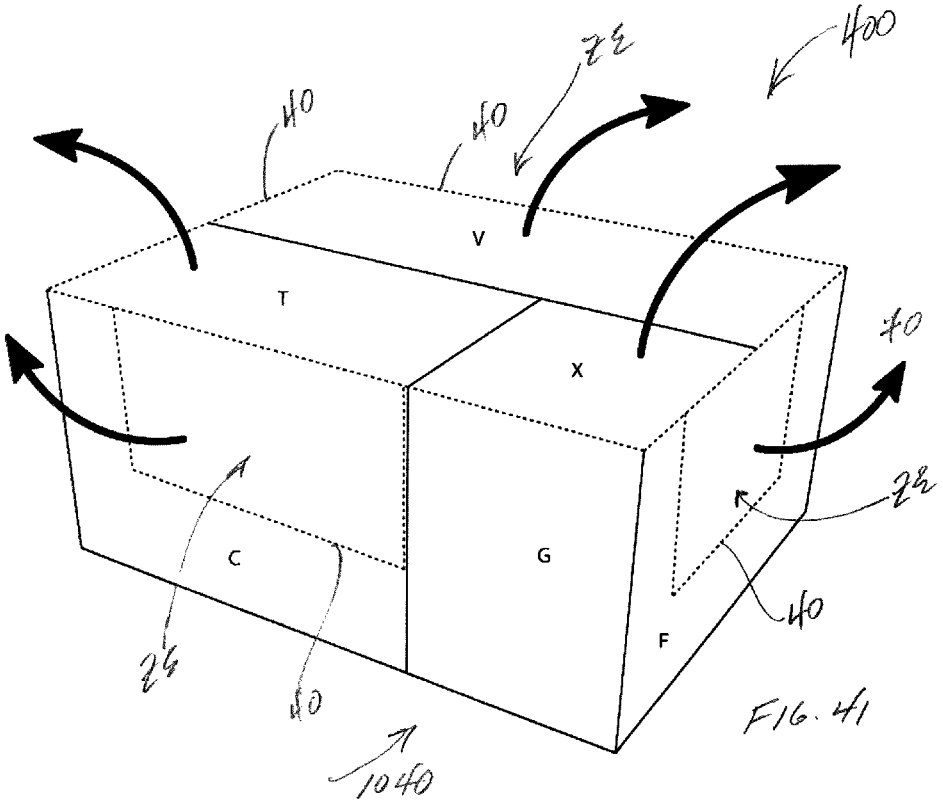
Figure 42:
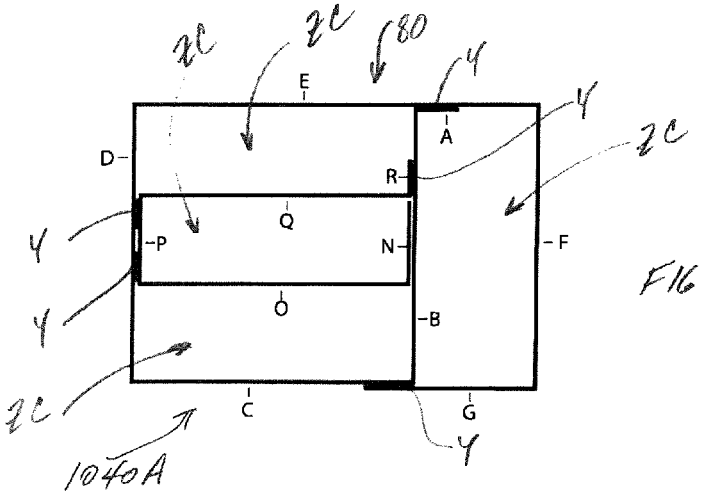
Figures 43, 44:
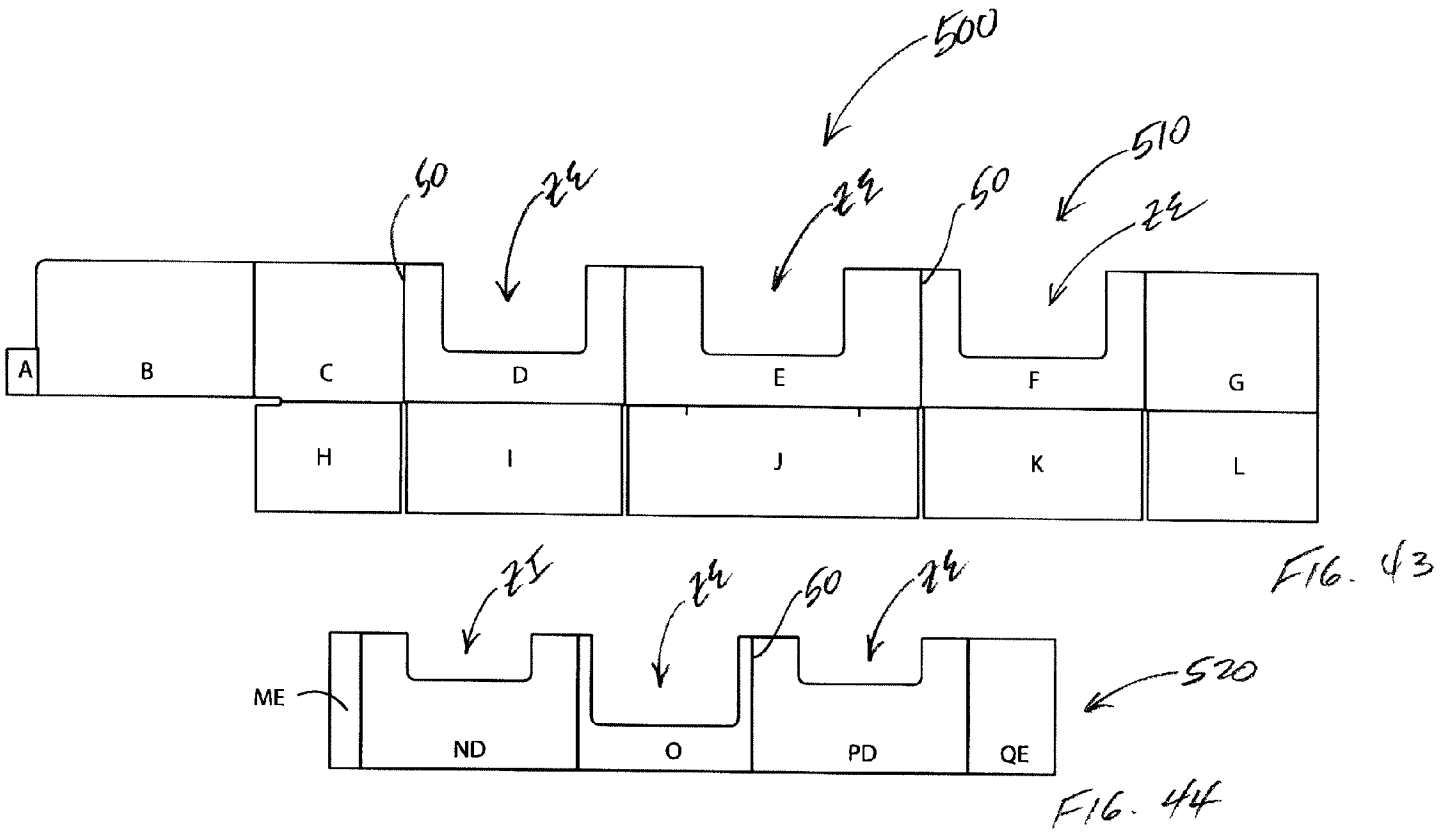
FIG. 43 illustrates a plan view of a primary blank used for manufacturing a container pre-assembly and a container in accordance with a fifth embodiment of a dual use tray/container, according to the present disclosure.
FIG. 44 illustrates a plan view of a supplementary blank used for manufacturing the container pre-assembly and container of the fifth embodiment of the dual use tray/container, according to the present disclosure.
Figures 45, 46, 47:
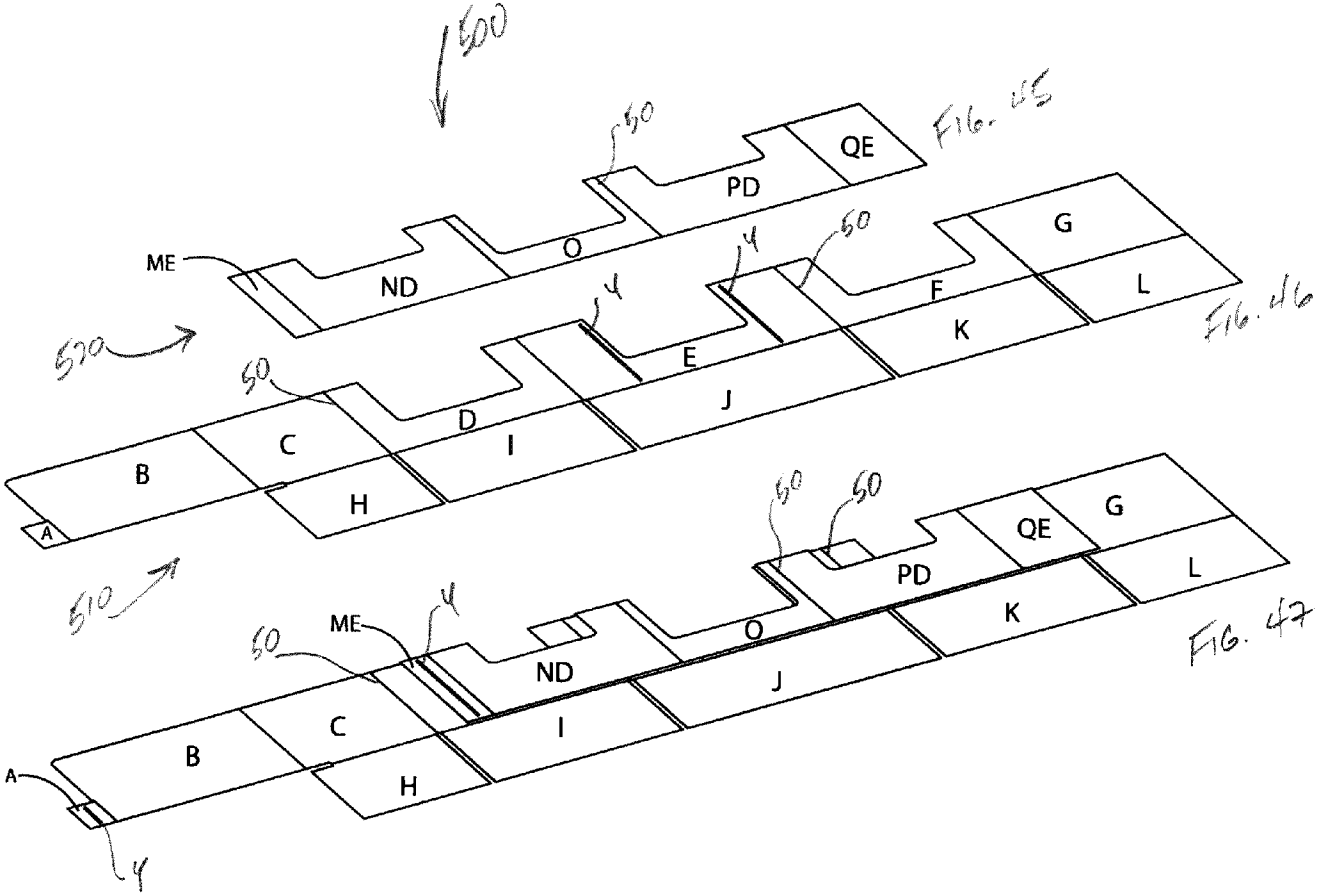
FIGS. 45-52 illustrate perspective views of steps of manufacturing the container pre-assembly and container from the blanks of FIGS. 43 and 44 and showing the erection and location of divider panels, internal cells, and access windows, according to the present disclosure.
Figure 48:
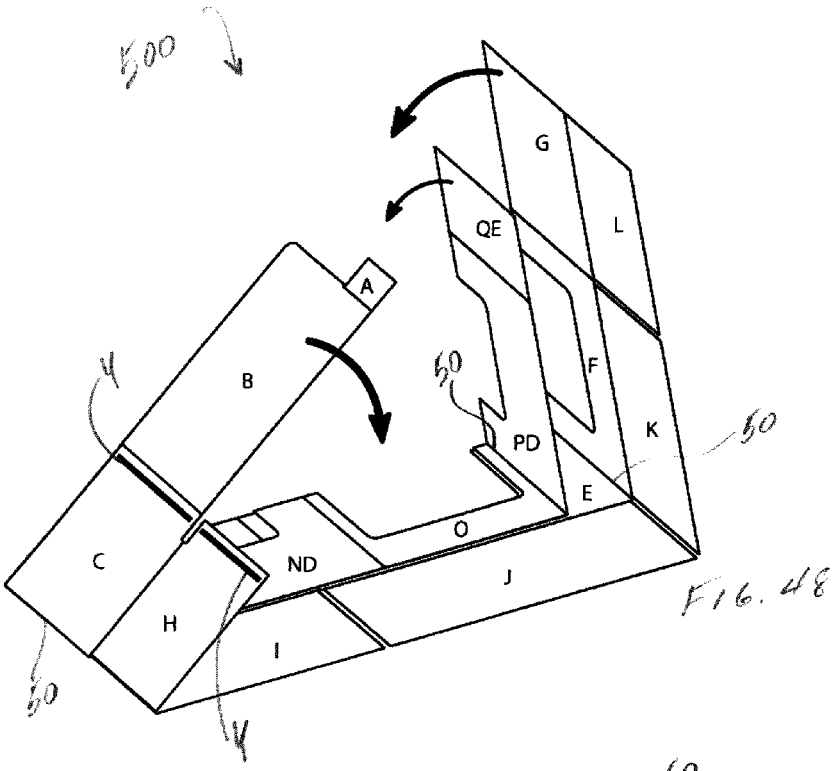
Figure 49:
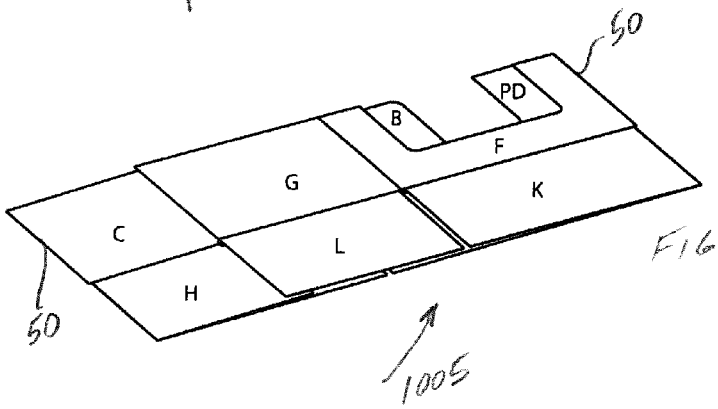

Thus, pre-assembly 1004 is first automatically erected into an initial closed-top, dual use display tray/container 1040 as shown in FIG. 41 and then, second, is convertible to a dual use display tray/container 1040A, as shown in FIG. 42. The closed-top container 1040 is automatically erected by using, for example, automated erector equipment (not shown) to move the top, side, bottom, extension, and divider panels to an opened configuration and then securing selected bottom panels to each other and selected top panels to each other to finish the erection of the closed-top, dual use display tray/container 1040. The open-top, dual use display tray/container 1040A is formed by removing top panels S, T, U, V, W and X and access window material from divider panel B and side panels C, E and F.

As shown in FIG. 42, dual use display tray/container 1040A includes cells ZC formed in the interior 80 by divider panels B, O and Q and side panels C-G, wherein divider panels B and Q are fixed or secured at glue points Y and divider panel O, while secured at glue points Y via extension panel P, is configured to be floating since extension panel N is not secured to divider panel B. Divider panels O and Q are shown substantially parallel to one another while divider panel B is substantially orthogonal to divider panels O and Q. Cells ZC are substantially equal in dimension to one another.

Figure 50:
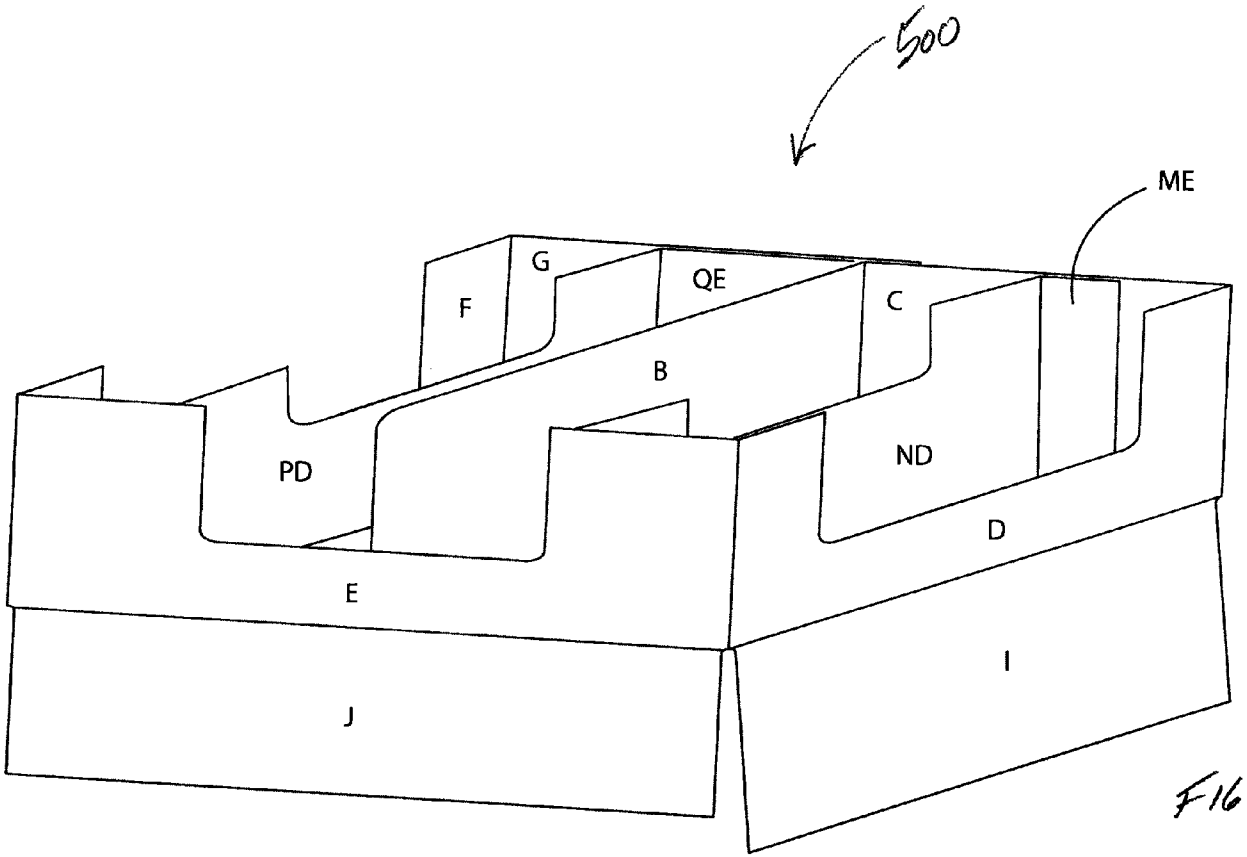

A fifth embodiment 500 (see FIGS. 43-52) includes a primary blank 510 and a supplementary blank 520. Primary blank 510 includes extension panel A, divider panel B, and side panels C, D, E, F and G. Supplementary blank 520 includes extension panels ME and QE, side panel O, and divider panels ND and PD. Primary blank 510 and supplementary blank 520 are combined, for example, by gluing side panel E to side panel O via glue points Y to ultimately form a pre-assembly 1005 by folding selected panels along fold lines 50 and via further glue points Y, as shown sequentially in FIGS. 45-49 (see arrows 60). Pre-assembly 1005 is automatically erected into dual use display tray/container 1050, as suggested or shown in FIGS. 50, 51 and 52 by using, for example, automated erector equipment (not shown) to move the side, bottom, extension, and divider panels to an opened configuration and then securing selected bottom panels to each other to finish the erection of the dual use display tray/container 1050.

Figure 51:
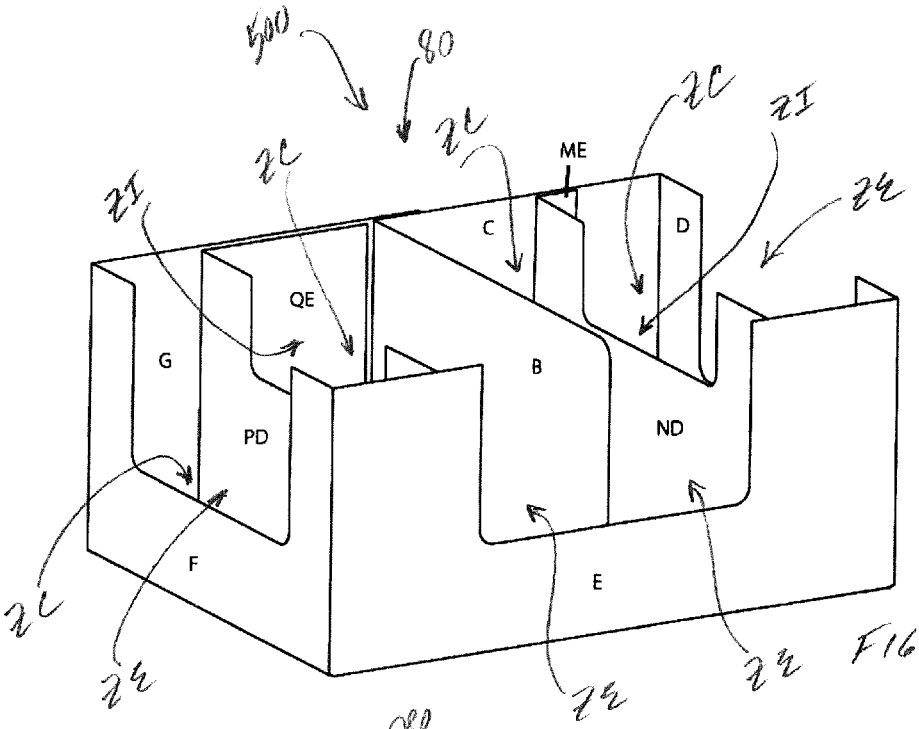
Figure 52:
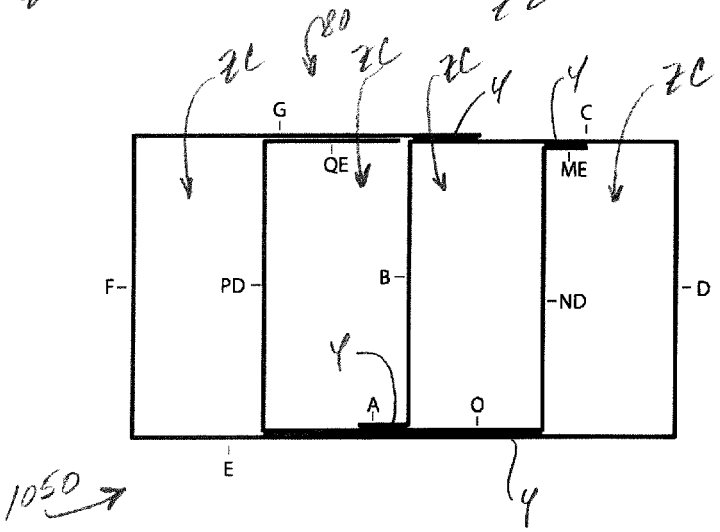

As shown in FIGS. 51 and 52, dual use display tray/container 1050 includes cells ZC formed in the interior 80 by divider panels B, ND and PD wherein divider panels B and ND are fixed or secured at glue points Y and divider panel PD, while secured at glue points Y via side panel E and extension panel A, is configured to be floating since extension panel QE is not secured to side panel G. Divider panels B, ND and PD are shown substantially parallel to one another. Cells ZC are substantially equal in dimension to one another.

In each of the embodiments 100-500, access windows ZE provide three-sided access to cells ZC and thus to any product stored and/or displayed in those cells ZC.

Divider panels designated as floating panels may be moved into use positions either during erection or during or after product is introduced into cells ZC.

Divider panels shown or suggested to be substantially parallel to one another and/or orthogonal to one another may, in accordance with the present disclosure, be configured to be at different angles with respect to each other.

As described herein, including in the descriptions as well as in the claims and shown in the drawings, the term "securing" or "adhering" or "fixing" or "adhering means" or "fixing means" can be accomplished by gluing or taping or their equivalent. Such securing, adhering or fixing means may be placed on either one or both of the panels to be adhered, secured or fixed to each other. Such securing, adhering or fixing means is shown in the drawings by solid bands of relatively short lengths and identified with alpha designation Y.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A method for manufacturing a dual use display tray/container pre-assembly having a plurality of auto-erectable cells, the method steps comprising:

providing a primary blank including a plurality of bottom panels, a plurality of side panels, a divider panel, and an extension panel extending from the divider panel, the primary blank having fold lines separating and connecting selected panels of the bottom, side, divider, and extension panels of the primary blank, wherein at least one of the plurality of side panels includes a cut-out portion creating an access window on at least one of the plurality of side panels;

providing a supplementary blank including a plurality of divider panels configured to separate ones of said plurality of auto-erectable cells from others of said auto-erectable cells and a plurality of extension panels, each of the plurality of extension panels extending from one of the plurality of divider panels, the supplementary blank including fold lines separating and connecting selected panels of the divider and extension panels of the supplementary blank;

adhering the primary and supplementary blanks to each other;

rotating and folding at least two of the selected panels of the primary blank and one of the selected panels of the secondary blank about the fold lines such that panels of the supplementary blank at least partially overlie panels of the supplementary blank and panels of the primary blank at least partially overlie panels of the primary blank and panels of the supplementary blank, and panels at least partially overlie panels of the primary blank;

adhering the extension panel of the primary blank to a first one of the plurality of side panels of the primary blank;

adhering a second one of the plurality of side panels to a third one of the plurality of side panels; and adhering a first one of the plurality of bottom panels to a second one of the plurality of bottom panels, thereby forming the pre-assembly having a plurality of auto-erectable cells.

2. The method of claim 1, further comprising the step of providing a plurality of top panels and access window material located in divider and side panels of the primary blank.

3. The method of claim 2, wherein the plurality of top panels and access window material are configured to be removed when the pre-assembly is erected into a dual use display tray/container to provide access to the plurality of auto-erectable cells.

4. The method of claim 1 further comprising the step of adhering one of said extension panels of said supplementary blank to said primary blank.

5. A dual use display tray/container pre-assembly having a plurality of auto-erectable cells, the pre-assembly comprising:

a primary blank including a plurality of bottom panels, a plurality of side panels, a divider panel, and an extension panel extending from the divider panel, the primary blank having fold lines separating and connecting selected panels of the bottom, side, divider, and extension panels of the primary blank, wherein at least one of the plurality of side panels includes a cut-out portion creating an access window on at least one of the plurality of side panels;

a supplementary blank including a plurality of divider panels configured to separate ones of said plurality of auto-erectable cells from others of said auto-erectable cells and a plurality of extension panels, each of the plurality of extension panels extending from one of the plurality of divider panels, the supplementary blank including fold lines separating and connecting selected panels of the divider and extension panels of the supplementary blank;

the primary and supplementary blanks being adhered to one another such that the plurality of divider panels and extension panels of the supplementary blank at least partially overlie a plurality of the side panels of the primary blank; and at least two of the selected panels of the primary blank and one of the selected panels of the secondary blank are arranged such that panels of the supplementary blank at least partially overlie panels of the supplementary blank and panels of the primary blank at least partially overlie panels of the primary blank and panels of the supplementary blank, and panels at least partially overlie panels of the primary blank;

the extension panel of the primary blank is adhered to a first one of the plurality of side panels of the primary blank;

a second one of the plurality of side panels is adhered to a third one of the plurality of side panels; and a first one of the plurality of bottom panels is adhered to a second one of the plurality of bottom panels, thereby forming the pre-assembly having a plurality of auto-erectable cells.

6. The pre-assembly of claim 5, wherein the plurality of auto-erectable cells are configured to be substantially equal in dimension to one another when the pre-assembly is erected into a dual use display tray/container.

7. The pre-assembly of claim 6, wherein at least two of the auto-erectable cells extend substantially parallel to one another and another of the plurality of auto-erectable cells extends substantially orthogonal to the at least two auto-erectable cells.

8. The pre-assembly of claim 6, wherein at least one of the divider panels of the supplementary blank is configured to be a floating panel and thus is not secured via an extension panel of the supplementary blank to the primary blank.

9. The pre-assembly of claim 8, wherein the at least one floating panel is configured to be moved into a use position after erection of the pre-assembly into a dual use display try/container having the plurality of auto-erected cells.

10. The pre-assembly of claim 6, wherein two of the divider panels of the supplementary panel are configured to be floating panels and thus are not secured by extension panels of the supplementary blank to the primary blank.

11. The pre-assembly of claim 5, wherein the primary blank further includes a plurality of top panels and also includes access window material on divider and side panels of the primary blank and the plurality of top panels and the access window material are configured to be removed when the pre-assembly is erected into a dual-use displaying tray/container to provide access to the plurality of auto-erected cells.

12. The pre-assembly of claim 5, wherein when the pre-assembly is erected into a dual-use display tray/container having the plurality of auto erected cells, the container provides three-sided access to the plurality of auto-erectable cells.

13. The method of claim 5 wherein one of said extension panels of said supplementary blank is adhered to said primary blank.

14. A method of manufacturing a dual use display tray/container having a plurality of divider panels automatically forming a plurality of auto-erectable cells in an interior of the dual use display tray/container, the method steps comprising:

providing a primary blank including a plurality of bottom panels, a plurality of side panels, a divider panel, and an extension panel extending from the divider panel, the primary blank having fold lines separating and connecting selected panels of the bottom, side, divider, and extension panels of the primary blank, wherein at least one of the plurality of side panels includes a cut-out portion creating an access window on at least one of the plurality of side panels;

providing a supplementary blank including a plurality of divider panels and a plurality of extension panels, each of the plurality of extension panels extending from one of the plurality of divider panels, the supplementary blank including fold lines separating and connecting selected panels of the divider and extension panels of the supplementary blank;

adhering the primary and supplementary blanks to each other;

rotating and folding at least two of the selected panels of the primary blank and one of the selected panels of the secondary blank about the fold lines such that panels of the supplementary blank at least partially overlie panels of the supplementary blank and panels of the primary blank at least partially overlie panels of the primary blank and panels of the supplementary blank, and panels at least partially overlie panels of the primary blank; and adhering the extension panel of the primary blank to a first one of the plurality of side panels of the primary blank;

adhering a second one of the plurality of side panels to a third one of the plurality of side panels;

adhering a first one of the plurality of bottom panels to a second one of the plurality of bottom panels, thereby forming the pre-assembly; and opening the pre-assembly by moving panels of the primary blank causing movement of panels of the supplementary blank such that a plurality of auto-erected cells are automatically formed in an interior of the container by a cooperative movement of the plurality of the divider panels and a plurality of the side panels.

15. The method of claim 14, further comprising the step of providing a plurality of top panels and access window material located in divider and side panels of the primary blank.

16. The method of claim 14, wherein the plurality of top panels and access window material are configured to be removed when the pre-assembly is erected into a dual use display tray/container to provide access to the plurality of auto-erectable cells.

* * * * *